US011244632B2

(12) United States Patent
Eom et al.

(10) Patent No.: US 11,244,632 B2
(45) Date of Patent: Feb. 8, 2022

(54) DISPLAY DRIVING INTEGRATED CIRCUIT AND DISPLAY DEVICE INCLUDING THE SAME

(71) Applicant: SAMSUNG ELECTRONICS CO., LTD., Suwon-si (KR)

(72) Inventors: Jeeyeon Eom, Hwaseong-si (KR); Soonchan Kwon, Anyang-si (KR); Kyungjik Min, Suwon-si (KR); Yeongshin Jang, Gwacheon-si (KR); Jeonghoon Choi, Hwaseong-si (KR); Siwoo Kim, Suwon-si (KR); Jaeyoun Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/026,639

(22) Filed: Sep. 21, 2020

(65) Prior Publication Data

US 2021/0264860 A1 Aug. 26, 2021

(30) Foreign Application Priority Data

Feb. 26, 2020 (KR) ..... 10-2020-0023403

(51) Int. Cl.
*G09G 3/00* (2006.01)
*G09G 3/3275* (2016.01)
*G09G 3/3258* (2016.01)

(52) U.S. Cl.
CPC ..... *G09G 3/3275* (2013.01); *G09G 3/3258* (2013.01); *G09G 3/006* (2013.01);
(Continued)

(58) Field of Classification Search
CPC .... G09G 3/3258; G09G 3/3275; G09G 3/006; G09G 2300/0814; G09G 2310/027;
(Continued)

(56) References Cited

U.S. PATENT DOCUMENTS 4,769,632 A * 9/1988 Work ..... G09G 5/06 345/519
5,956,006 A * 9/1999 Sato ..... G09G 3/3607 345/88

(Continued)

FOREIGN PATENT DOCUMENTS

CN 102968236 A 3/2013

*Primary Examiner* — Michael J Eurice
(74) *Attorney, Agent, or Firm* — Lee IP Law, PC

(57) ABSTRACT

A display driving integrated circuit includes a timing controller, a first source driver including a first inverting input, a first non-inverting input, and a first output, a second source driver including a second inverting input, a second non-inverting input, and a second output, and a switching circuit connected with the display panel through a first and second pads. Under control of the timing controller, the switching circuit performs one of a first switching operation of connecting the first inverting input and the first output with the first pad, connecting the second inverting input and the second output with the second pad, and applying first and second decoding voltages to the non-inverting inputs, respectively; and a second switching operation of applying a sensing reference voltage to the non-inverting inputs, and connecting the output terminals with an output node, and connecting the inverting inputs with one pad.

20 Claims, 27 Drawing Sheets

(52) U.S. Cl.
CPC . *G09G 2300/0814* (2013.01); *G09G 2310/08* (2013.01); *G09G 2330/028* (2013.01)

(58) Field of Classification Search
CPC ..... G09G 2310/0291; G09G 2310/061; G09G 2310/08; G09G 2320/0295; G09G 2320/045; G09G 2330/028
See application file for complete search history.

(56) References Cited

U.S. PATENT DOCUMENTS

| | | | | |
|---|---|---|---|---|
| 7,960,993 | B2 | 6/2011 | Gardner et al. | |
| 8,416,227 | B2 | 4/2013 | Fujioka et al. | |
| 8,514,191 | B2 | 8/2013 | Wang et al. | |
| 8,581,809 | B2 | 11/2013 | Nathan et al. | |
| 9,685,119 | B2 | 6/2017 | Kim et al. | |
| 9,799,248 | B2 | 10/2017 | Chaji et al. | |
| 10,360,827 | B2 | 7/2019 | Bl et al. | |
| 2003/0214506 | A1* | 11/2003 | Koselj | G09G 3/3685 345/519 |
| 2010/0045334 | A1* | 2/2010 | Gardner | G09G 3/006 324/760.01 |
| 2010/0073335 | A1* | 3/2010 | Min | G09G 3/3233 345/204 |
| 2011/0007047 | A1* | 1/2011 | Fujioka | G02F 1/133509 345/207 |
| 2015/0163403 | A1* | 6/2015 | Wakabayashi | H04N 5/378 348/308 |
| 2015/0212643 | A1 | 7/2015 | Lee et al. | |
| 2015/0379937 | A1* | 12/2015 | Kim | G09G 3/3291 345/691 |
| 2017/0103688 | A1 | 4/2017 | Bl et al. | |
| 2017/0103702 | A1 | 4/2017 | Bl et al. | |
| 2017/0103703 | A1* | 4/2017 | Bi | G09G 3/3291 |
| 2017/0140687 | A1* | 5/2017 | Chaji | G09G 3/3291 |
| 2019/0004105 | A1 | 1/2019 | Henley | |

* cited by examiner

DISPLAY DRIVING INTEGRATED CIRCUIT AND DISPLAY DEVICE INCLUDING THE SAME

CROSS-REFERENCE TO RELATED APPLICATION

Korean Patent Application No. 10-2020-0023403, filed on Feb. 26, 2020, in the Korean Intellectual Property Office, and entitled: "Display Driving Integrated Circuit and Display Device Including the Same," is incorporated by reference herein in its entirety.

BACKGROUND

1. Field

Embodiments relate to a display driving integrated circuit and a display device including the same.

2. Description of the Related Art

An organic light-emitting diode (OLED) is being developed as one of light-emitting elements. Because the organic light-emitting diode has a spontaneous light-emitting characteristic, an organic light-emitting diode display device does not require an additional component for light-emitting, such as a backlight unit. Accordingly, a display device using the organic light-emitting diode is being researched and developed. A display panel including the organic light-emitting diode may include pixels arranged in rows and columns, where each pixel includes one organic light-emitting diode and one transistor. The transistor may adjust brightness of the organic light-emitting diode by adjusting the amount of current flowing through the organic light-emitting diode.

SUMMARY

Embodiments are directed to a display driving integrated circuit for a display panel, the display driving integrated circuit including: a timing controller; a first source driver including a first inverting input terminal, a first non-inverting input terminal, and a first output terminal; a second source driver including a second inverting input terminal, a second non-inverting input terminal, and a second output terminal; and a switching circuit that connects with the display panel through a first pad and a second pad, the switching circuit including a plurality of switches connected between the first and second pads and the first and second source drivers. Under control of the timing controller, the switching circuit may be configured to perform one of: a first switching operation of controlling the plurality of switches such that the first inverting input terminal and the first output terminal are connected with the first pad, a first decoding voltage is applied to the first non-inverting input terminal, the second inverting input terminal and the second output terminal are connected with the second pad, and a second decoding voltage is applied to the second non-inverting input terminal; and a second switching operation of controlling the plurality of switches such that a sensing reference voltage is applied to the first non-inverting input terminal and the second non-inverting input terminal, the first output terminal and the second output terminal are connected with an output node, and the first inverting input terminal and the second inverting input terminal are connected with one pad of the first and second pads.

Embodiments are also directed to a display driving integrated circuit for a display panel, the display driving integrated circuit including: a timing controller; a column control block including a plurality of source drivers, and configured to control voltages of a plurality of pixel lines, which connect to the display panel, using the plurality of source drivers, and to receive pixel information through the plurality of pixel lines using the plurality of source drivers, under control of the timing controller; an analog-to-digital converter configured to convert the pixel information received by the column control block into sensing data; and a memory configured to store the sensing data.

Embodiments are also directed to a display device, including: a display panel including a plurality of pixels; and a display driving integrated circuit configured to control the plurality of pixels, the display driving integrated circuit including a plurality of source drivers connected with the plurality of pixels through a plurality of pixel lines. In a display operation of the plurality of pixels, the plurality of source drivers may output a plurality of decoding voltages to the plurality of pixel lines, respectively, and, in a sensing operation of at least one pixel of the plurality of pixels, the plurality of source drivers may be configured to receive pixel information through a pixel line connected with the at least one pixel from among the plurality of pixel lines.

Embodiments are also directed to a method of operating a display driving integrated circuit that includes a plurality of source drivers configured to control a plurality of pixels included in a display panel, the method including: outputting a corresponding voltage to the plurality of pixels through the plurality of source drivers, in a display operation of the plurality of pixels; and sensing pixel information from at least one pixel of the plurality of pixels through the plurality of source drivers, in a sensing operation of the at least one pixel. The pixel information may include information about a degree of degradation of the at least one pixel.

Embodiments are also directed to a method of operating a display driving integrated circuit that includes a plurality of source drivers configured to control a plurality of pixels included in a display panel, the method including: controlling first pixels located at a first row from among the plurality of pixels using the plurality of source drivers and sensing first pixel information from at least one pixel of the first pixels using the plurality of source drivers, during a first period of a vertical synchronization signal and a first period of a horizontal synchronization period; and controlling second pixels located at a second row from among the plurality of pixels using the plurality of source drivers and sensing second pixel information from at least one pixel of the second pixels using the plurality of source drivers, during the first period of the vertical synchronization signal and a second period of the horizontal synchronization period. The first pixel information may include information about a degree of degradation of the at least one pixel of the first pixels, and the second pixel information includes information about a degree of degradation of the at least one pixel of the second pixels.

Embodiments are also directed to a method of operating a display driving integrated circuit that includes a plurality of source drivers configured to control a plurality of pixels included in a display panel, the method including: controlling the plurality of pixels using the plurality of source drivers based on a horizontal synchronization signal; and sensing pixel information from at least one pixel of the plurality of pixels using the plurality of source drivers, in a vertical blank period. The pixel information may include information about a degree of degradation of the at least one pixel.

BRIEF DESCRIPTION OF THE DRAWINGS

Features will become apparent to those of skill in the art by describing in detail example embodiments with reference to the attached drawings in which.

DETAILED DESCRIPTION

Figure 1:
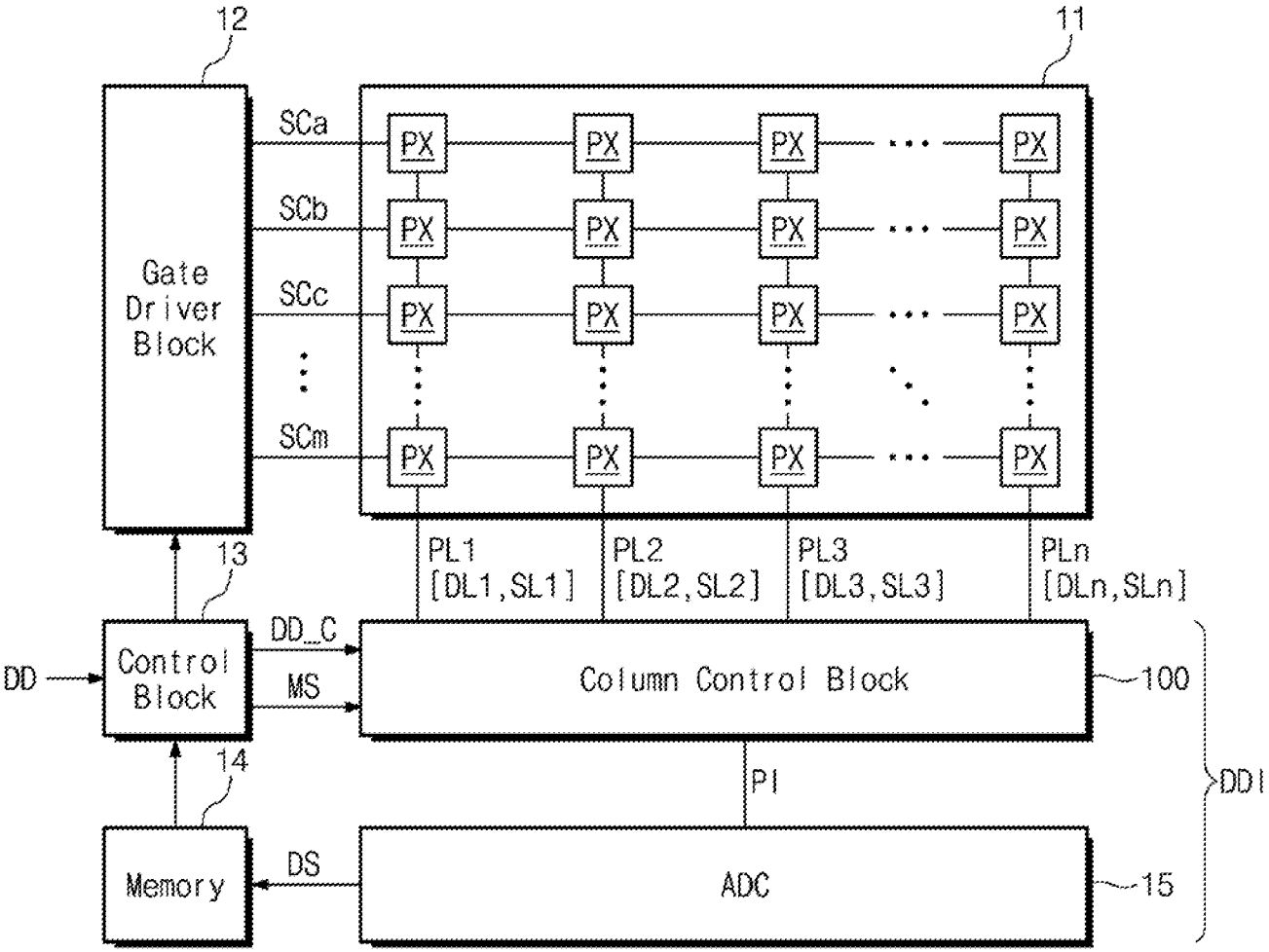
FIG. 1 is a block diagram illustrating a display device according to an example embodiment.

FIG. 1 is a block diagram illustrating a display device according to an example embodiment. Referring to FIG. 1, a display device 10 may include a display panel 11, a gate driver block 12, a control block 13, a memory 14, an analog-to-digital converter 15 (ADC), and a column control block 100. In an example embodiment, at least a part of the gate driver block 12, the control block 13, the memory 14, the analog-to-digital converter 15, and the column control block 100 may be included in a display driving integrated circuit DDI.

The display panel 11 may include a plurality of pixels PX. The plurality of pixels PX may be arranged in rows and columns. The plurality of pixels PX may be connected with scan lines SCa to SCm and pixel lines PL1 to PLn. In an example embodiment, the display panel 11 may be implemented with various display panels such as a liquid crystal display panel, an organic light emitting display panel, an electrophoretic display panel, an electrowetting display panel, or other display panels. In an example embodiment, the display device 10 including the liquid crystal display panel may further include a polarizer (not illustrated), a backlight unit (not illustrated), etc. Below, for convenience of description, it is assumed that the display panel 11 is an organic light emitting display panel including pixels based on an organic light-emitting diode (OLED).

The gate driver block 12 may be connected with the plurality of pixels PX through the scan lines SCa to SCm. The gate driver block 12 may control voltages of the scan lines SCa to SCm under control of the control block 13.

The control block 13 may receive display data DD from an external host device (e.g., a host device such as an application processor (AP) or a graphics processing unit (GPU)). The control block 13 may control the gate driver block 12 such that the gate driver block 12 activates or selects the plurality of pixels PX sequentially or non-sequentially in units of a row.

In an example embodiment, the control block 13 may perform an external compensation operation on the display panel 11 or the plurality of pixels PX. For example, the memory 14 may include pixel information about each of the plurality of pixels PX of the display panel 11. The control block 13 may perform external compensation on the display data DD received from the external device based on the pixel information stored in the memory 14, and may output external compensated display data DD_C (hereinafter referred to as "compensation data"). The compensation data DD_C may be provided to the column control block 100. In an example embodiment, the control block 13 may be or include a timing controller configured to control operation timings of the display device 10.

The column control block 100 may be connected with the plurality of pixels PX through the plurality of pixel lines PL1 to PLn. In an example embodiment, the plurality of pixel lines PL1 to PLn may include data lines DL1 to DLn and sensing lines SL1 to SLn. The data lines DL1 to DLn may be signal lines through which signals based on the compensation data DD_C are provided from the column control block 100 to the pixels PX, and the sensing lines SL1 to SLn may be signal lines through which pixel information PI is provided from the pixels PX to the column control block 100. In an example embodiment, depending on an implementation of the pixel PX or the display panel 11, a data line and a sensing line connected with one pixel may be separated from each other or may be the same line, as more fully described below with reference to the drawings The column control block 100 may control the pixel lines PL1 to PLn under control of the control block 13 (e.g., in response to a mode signal MS). The column control block 100 may include a plurality of source drivers respectively connected with the pixel lines PL1 to PLn. The plurality of source drivers may receive the compensation data DD_C from the control block 13, and may control the pixel lines PL1 to PLn based on the received compensation data DD_C.

In an example embodiment, the column control block 100 may sense the pixel information PI of each of the plurality of pixels PX under control of the control block 13 (e.g., in response to the mode signal MS). For example, as described above, the column control block 100 may include the plurality of source drivers respectively connected with the pixel lines PL1 to PLn. The pixel information PI from the plurality of pixels PX may be sensed through the plurality of source drivers. Thus, the display device 10 according to an example embodiment may sense the pixel information PI using the plurality of source drivers configured to control the pixels PX, without a separate low-noise amplifier for sensing the pixel information PI. A configuration and an operation of the column control block 100 will be more fully described below with reference to the drawings.

The analog-to-digital converter 15 may convert the pixel information PI into a digital signal to output sensing data DS. The sensing data DS corresponding to the digital signal may be stored in the memory 14. In an example embodiment, the pixel information PI may be information about a current or a voltage sensed from each of the plurality of pixels PX. The pixel information PI may be information indicating the degree of degradation of each of the plurality of pixels PX. For example, the pixel information PI may include information about the degree of degradation of the organic light-emitting diode (OLED) or transistors included in each of the plurality of pixels PX.

As described above, the display device 10 according to an example embodiment may sense the pixel information PI from the pixels PX using the plurality of source drivers configured to control the pixel lines PL1 to PLn (e.g., the data lines DL1 to DLn) connected with the pixels PX, without using a separate amplifier (e.g., a low-noise amplifier) for sensing the pixel information PI. Accordingly, the size of the display driving integrated circuit DDI may be decreased by as much as the size of the low-noise amplifier, and costs to implement a display driving integrated circuit may decrease.

Below, the terms "display operation of a pixel" and "sensing operation of a pixel" are used. The display operation of the pixel indicates an operation of allowing a pixel to express brightness corresponding to display data or compensation data, and the sensing operation of the pixel indicates an operation of sensing the pixel information PI from the pixel.

Figure 2A:
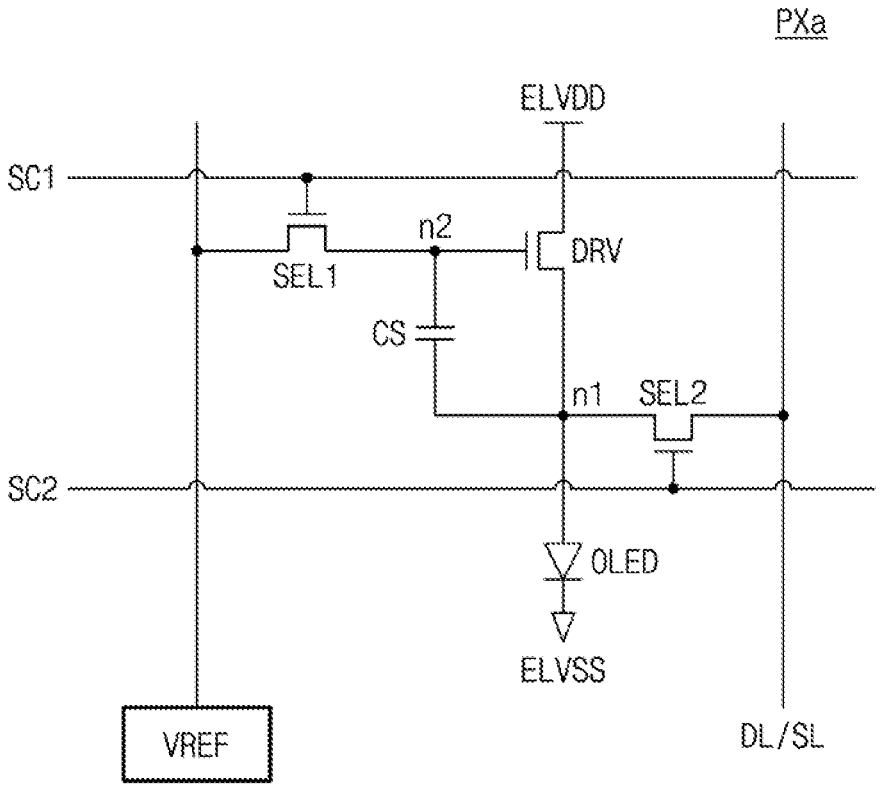
FIGS. 2A to 2C are circuit diagrams illustrating example structures of a pixel of FIG. 1.
Figure 2B:
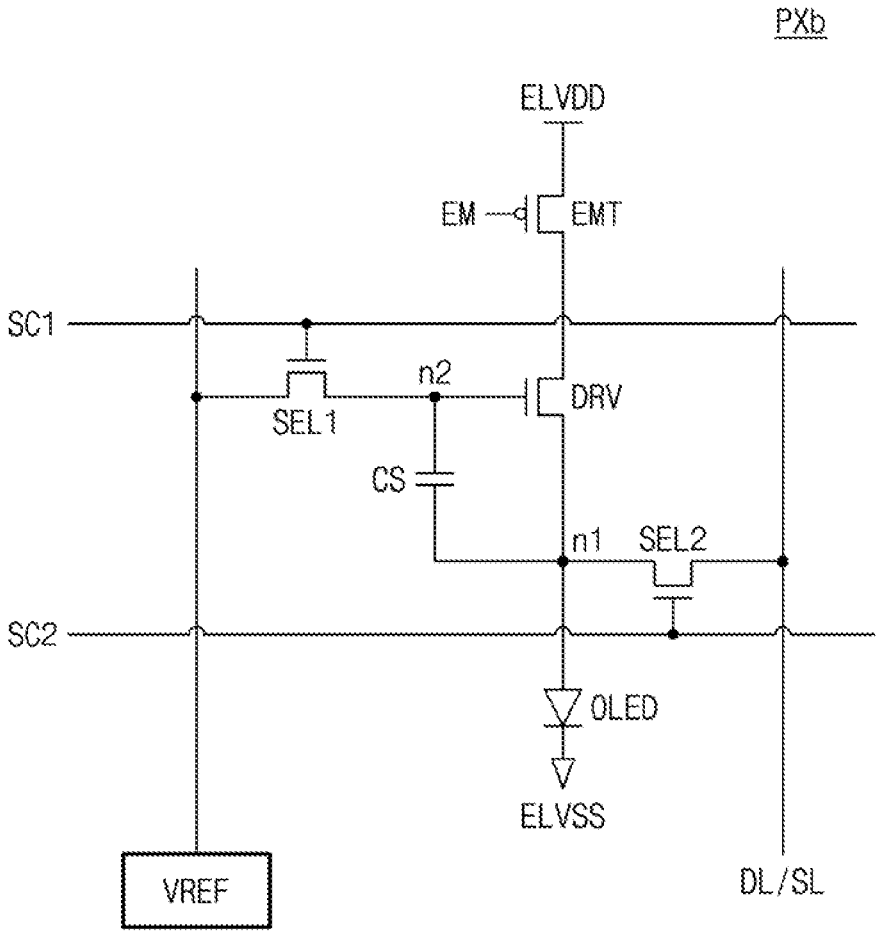
Figure 2C:
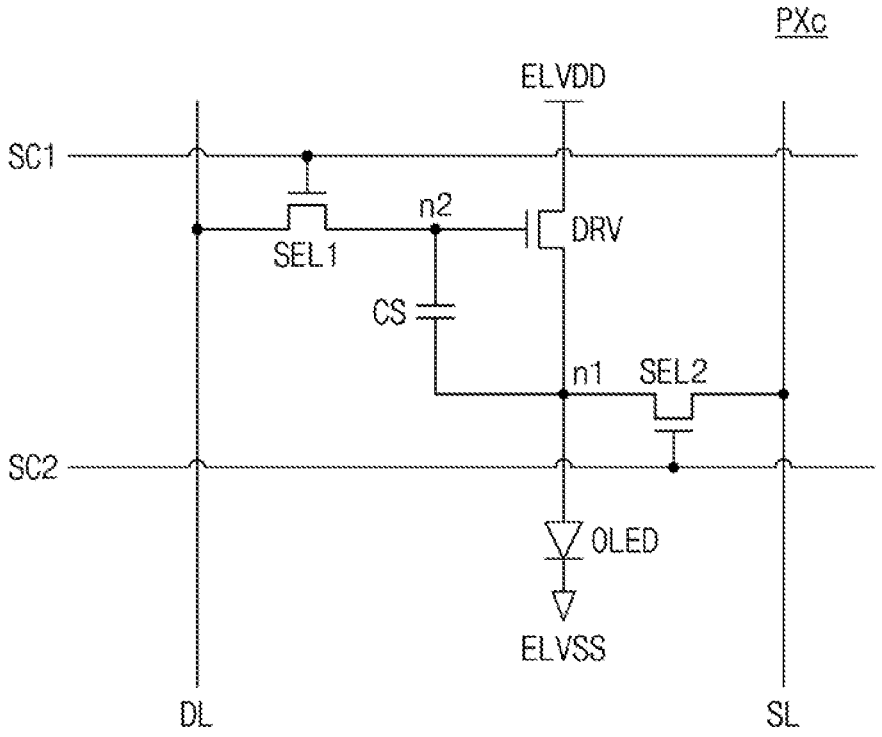

FIGS. 2A to 2C are circuit diagrams illustrating example structures of a pixel of FIG. 1. A part of an example pixel structure will be described with reference to FIGS. 2A to 2C, but the plurality of pixels PX may have a structure different from structures of pixels PXa, PXb, and PXc illustrated in FIGS. 2A to 2C.

Referring to FIGS. 1 and 2A, the pixel PXa may include a first selection transistor SEL1, a second selection transistor SEL2, a driving transistor DRV, a capacitor CS, and an organic light-emitting diode OLED.

The first selection transistor SEL1 may be connected between a reference voltage VREF and a second node n2, and may operate in response to a signal of a first scan line SC1. The second selection transistor SEL2 may be connected between a data line/sensing line DL/SL and a first node n1, and may operate in response to a signal of a second scan line SC2. The driving transistor DRV may be connected between a first power supply voltage ELVDD and the first node n1, and may operate in response to a voltage of the second node n2. The capacitor CS may be connected between the first node n1 and the second node n2. The organic light-emitting diode OLED may be connected between the first node n1 and a second power supply voltage ELVSS.

In an example embodiment, in the case where the display operation of the pixel PXa is performed, a voltage corresponding to the compensation data DD_C may be provided to the data line/sensing line DL/SL by a source driver (e.g., a source driver included in the column control block 100 of FIG. 1) corresponding to the pixel PX. In this case, the data line/sensing line DL/SL is used as a data line. As an on-voltage is provided to the first scan line SC1 and the second scan line SC2, the first selection transistor SEL1 and the second selection transistor SEL2 may be turned on by the on-voltage. As such, the second node n2 may be set to the reference voltage VREF, and the first node n1 may be set to a voltage corresponding to the compensation data DD_C. The amount of current flowing through the driving transistor DRV may be decided by a voltage difference of the second node n2 and the first node n1, and the brightness of the organic light-emitting diode OLED may be adjusted depending on the amount of current flowing through the driving transistor DRV.

In an example embodiment, in the case where the sensing operation of the pixel PXa is performed, the second selection transistor SEL2 may be turned on by the on-voltage of the second scan line SC2. In this case, the pixel information PI (or current or voltage information) may be provided to the column control block 100 through the first node n1 and the data line/sensing line DL/SL. For example, in the display operation of the pixel PXa, even though a signal corresponding to display data having a specific value is provided to the first node n1, a voltage of the first node n1 or the amount of current flowing through the driving transistor DRV may not be uniform due to degradation of the driving transistor DRV, degradation of the organic light-emitting diode OLED, or degradation of the first and second selection transistors SEL1 and SEL2. In this case, the brightness of a light emitted from the organic light-emitting diode OLED may vary from a target. Thus, the pixel information PI indicating a characteristic or degradation of various elements included in the pixel PXa may be sensed through the sensing operation of the pixel PXa. As described above, the pixel information PI may indicate a voltage or a current of the first node n1, and may be provided to the column control block 100 through the data line/sensing line DL/SL. In an example embodiment, a node through which the pixel information PI is output may change depending on a pixel structure.

Referring to FIGS. 1 and 2B, the pixel PXb may include the first selection transistor SEL1, the second selection transistor SEL2, the driving transistor DRV, the capacitor CS, the organic light-emitting diode OLED, and a light-emitting control transistor EMT.

The first selection transistor SEL1, the second selection transistor SEL2, the driving transistor DRV, the capacitor CS, and the organic light-emitting diode OLED are described with reference to the pixel PXa of FIG. 2A, and thus, additional description will be omitted to avoid redundancy. The light-emitting control transistor EMT may be connected between the first power supply voltage ELVDD and the driving transistor DRV, and may operate in response to a light-emitting control signal EM. A driving operation of the pixel PXb and a structure of the pixel PXb are similar to the way to drive the pixel PXa and the structure of the pixel PXa except for the light-emitting control transistor EMT, and thus, additional description will be omitted to avoid redundancy.

Referring to FIG. 2C, the pixel PXc may include the first selection transistor SEL1, the second selection transistor SEL2, the driving transistor DRV, the capacitor CS, and the organic light-emitting diode OLED. A connection relationship of the first selection transistor SEL1, the second selection transistor SEL2, the driving transistor DRV, the capacitor CS, and the organic light-emitting diode OLED is described with reference to the pixel PXa of FIG. 2A, and thus, additional description will be omitted to avoid redundancy.

An operation and a structure of the pixel PXc of FIG. 2C may be similar to those of the pixel PXa of FIG. 2A except that the data line DL and the sensing line SL are separated. For example, in the case where the display operation of the pixel PXc is performed, a signal corresponding to the display data DD or the compensation data DD_C may be provided through the data line DL, and thus, the first node n1 may be set to a voltage corresponding to the display data DD or the compensation data DD_C. The amount of current flowing through the driving transistor DRV may be decided by a voltage of the second node n2, and thus, the brightness of the organic light-emitting diode OLED may be controlled.

In an example embodiment, the first and second scan lines SC1 and SC2 and the light-emitting control signal EM described with reference to FIGS. 2A to 2C may be included in the plurality of scan lines SCa to SCm described with reference to FIG. 1. Thus, depending on the implementation of a pixel, one or more scan lines may be connected with one pixel.

As described above, a structure of the plurality of pixels PX included in the display panel 11 may vary depending on the implementation. The pixel structures described with reference to FIGS. 2A to 2C are examples. In an example embodiment, depending on a structure of the pixel PX, the pixel PX may be connected with a line through which a data signal is received and a line through which the pixel information PI is output, or may be connected with a line through which a data signal is received or the pixel information PI is output.

Figure 3:
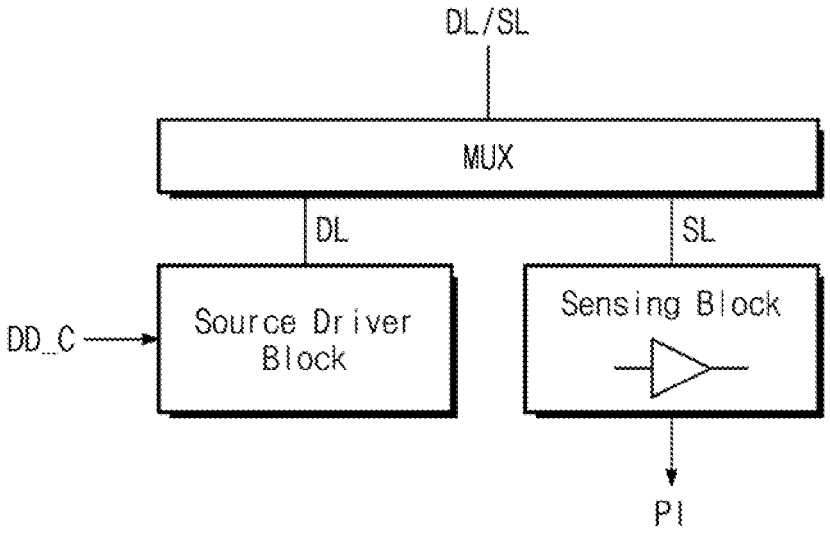
FIG. 3 is a block diagram illustrating a general configuration of a source driver block and a sensing block of a display driving integrated circuit.

FIG. 3 is a block diagram illustrating a general configuration of a source driver block and a sensing block of a display driving integrated circuit. In the general configuration shown in FIG. 3, a multiplexer MUX may be connected with a display panel through data lines/sensing lines DL/SL. A source driver block may be connected with the multiplexer MUX through the data lines DL. The source driver block may receive compensation data and may control the data lines DL based on the received compensation data. Thus, the source driver block may be configured to control a display operation of pixels included in the display panel. A sensing block may be connected with the multiplexer MUX through the sensing lines SL. The sensing block may sense pixel information PI provided from the pixels of the display panel through the sensing lines SL. The sensing block may be implemented with a low-noise amplifier. In a general display driving integrated circuit, there may be separately provided components for the source driver block (configured to control the display operation of pixels) and the sensing block (configured to perform the sensing operation of the pixels). The sensing block may be implemented with a low-noise amplifier. Because the low-noise amplifier may occupy a relatively large area, the size of the general display driving integrated circuit may be relatively large.

Figure 4:
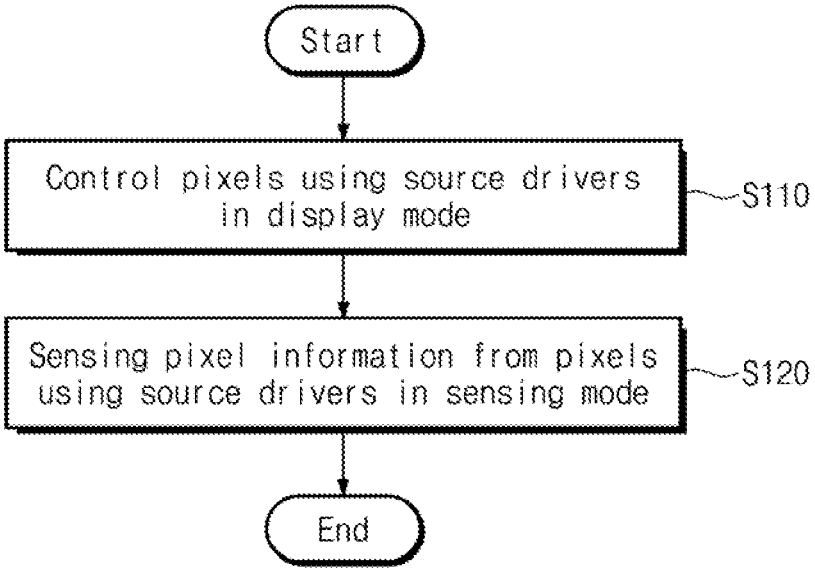
FIG. 4 is a flowchart illustrating an operation of a display device of FIG. 1.

FIG. 4 is a flowchart illustrating an operation of a display device of FIG. 1. Referring to FIGS. 1 and 4, in operation S110, the display device 10 may control pixels using source drivers in a display mode. For example, in the display mode, the display device 10 may provide signals corresponding to the display data DD or the compensation data DD_C to the pixels using a plurality of source drivers included in the column control block 100. The pixels may emit lights in response to the signals provided from the plurality of source drivers.

In operation S120, the display device 10 may sense pixel information from the pixels using the source drivers in a sensing mode. For example, in the sensing mode, the display device 10 may sense the pixel information PI from each of the pixels using the plurality of source drivers included in the column control block 100. According to an example embodiment, the plurality of source drivers may be used as one low-noise amplifier through merging or parallel connection.

As described above, the display device 10 according to an example embodiment may sense pixel information from pixels through source drivers configured to control data lines of pixels without a dedicated separate amplifier.

Figure 5:
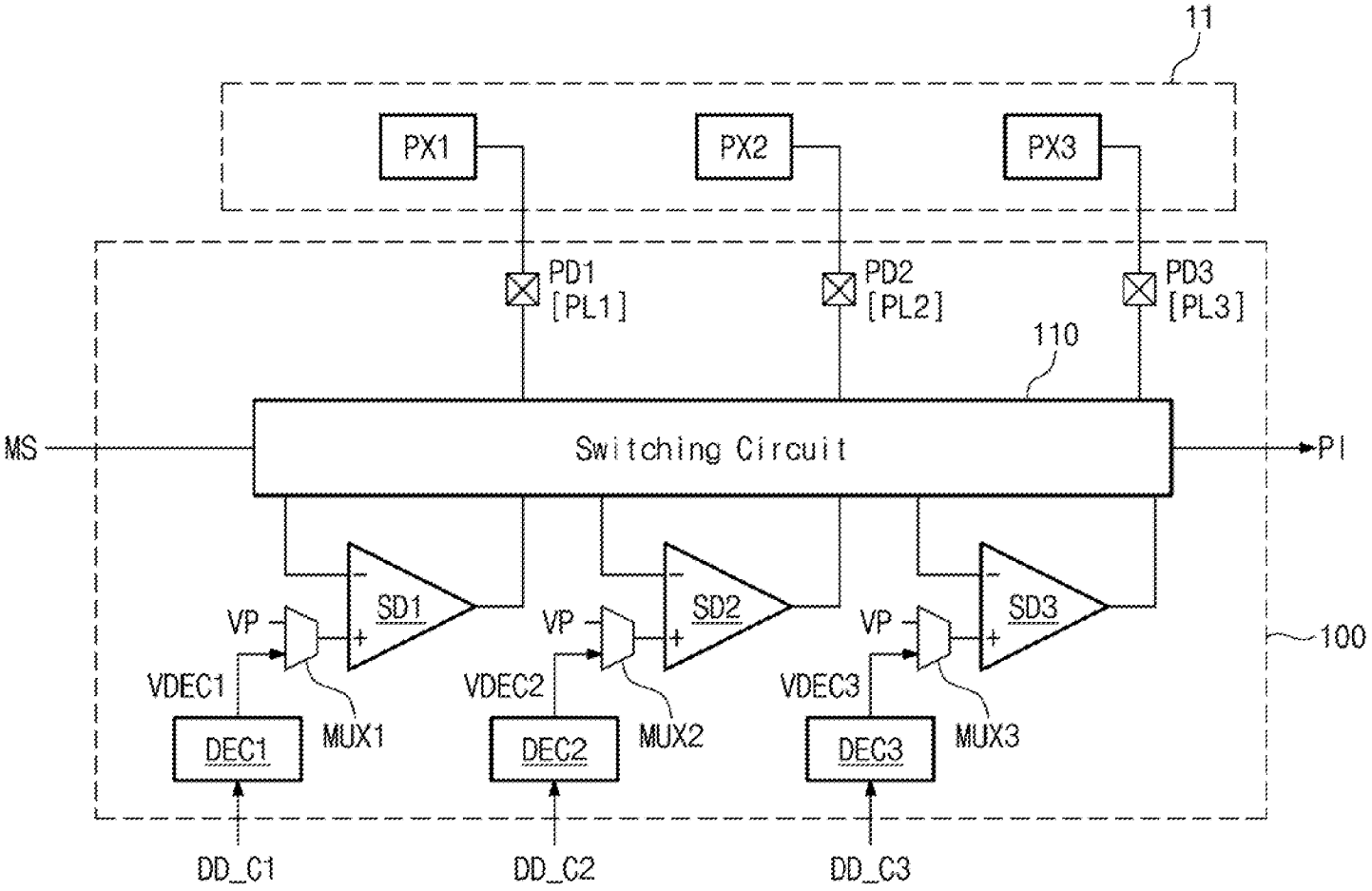
FIG. 5 is a diagram illustrating a column control block of FIG. 1.

FIG. 5 is a diagram illustrating a column control block of FIG. 1. Below, it is assumed that one pixel is connected with one pixel line PL and one pixel line PL is used as a data line DL or a sensing line SL depending on a driving scheme (i.e., the display operation or the sensing operation). Thus, in the following description, a pixel line connected with one pixel may not be classified as the data line DL or the sensing line SL, and the use of the pixel line may be decided depending on a driving scheme. However, for example, a data line and a sensing line may be connected with one pixel depending on an implementation of a pixel.

Below, for convenience of description, example embodiments will be described on a basis of three pixels PX1, PX2, and PX3. However, the number of pixels may be varied.

Referring to FIGS. 1 and 5, the column control block 100 may include first to third pads PD1 to PD3, a switching circuit 110, first to third source drivers SD1 to SD3, first to third selection circuits MUX1 to MUX3, and first to third decoders DEC1 to DEC3.

The first to third pads PD1 to PD3 may be respectively connected with the first to third pixel lines PL1 to PL3. For example, the first pad PD1 may be connected with the first pixel line PL1 corresponding to a first pixel PX1 of the display panel 11, the second pad PD2 may be connected with the second pixel line PL2 corresponding to a second pixel PX2 of the display panel 11, and the third pad PD3 may be connected with the third pixel line PL3 corresponding to a third pixel PX3 of the display panel 11.

The switching circuit 110 may be connected with the first to third pads PD1 to PD3, and may be connected with output terminals and inverting input terminals of the first to third source drivers SD1 to SD3.

The first decoder DEC1 may decode first compensation data DD_C1 from the control block 13 to output a first decoding voltage VDEC1. The first selection circuit MUX1 may select and output one of the first decoding voltage VDEC1 and a sensing reference voltage VP. An output of the first selection circuit MUX1 may be provided to a non-inverting input terminal of the first source driver SD1.

The second decoder DEC2 may decode second compensation data DD_C2 from the control block 13 to output a second decoding voltage VDEC2. The second selection circuit MUX2 may select and output one of the second decoding voltage VDEC2 and the sensing reference voltage VP. An output of the second selection circuit MUX2 may be provided to a non-inverting input terminal of the second source driver SD2.

The third decoder DEC3 may decode third compensation data DD_C3 from the control block 13 to output a third decoding voltage VDEC3. The third selection circuit MUX3 may select and output one of the third decoding voltage VDEC3 and the sensing reference voltage VP. An output of the third selection circuit MUX3 may be provided to a non-inverting input terminal of the third source driver SD3.

The switching circuit 110 may receive the mode signal MS from the control block 13, and may perform a switching operation between the above signal lines in response to the received mode signal MS. For example, when the mode signal MS indicates the display operation of the pixel, the switching circuit 110 may perform the switching operation such that the output of the first source driver SD1 is connected with the first pixel line PL1 of the first pad PD1, the output of the second source driver SD2 is connected with the second pixel line PL2 of the second pad PD2, and the output of the third source driver SD3 is connected with the third pixel line PL3 of the third pad PD3.

When the mode signal MS indicates the sensing operation, the switching circuit 110 may perform the switching operation such that the inverting input terminals and the output terminals of the first to third source drivers SD1 to SD3 are connected in parallel. According to the switching operation of the switching circuit 110, the pixel information PI may be output from the output terminals of the first to third source drivers SD1 to SD3 (or from the switching circuit 110). A structure and an operation of the switching circuit 110 will be more fully described below with reference to the drawings.

In an example embodiment, the first to third selection circuits MUX1 to MUX3 may operate in response to the mode signal MS. For example, when the mode signal MS indicates the display operation of the pixel, the first to third selection circuits MUX1 to MUX3 may select and output the first to third decoding voltages VDEC1 to VDEC3. Thus, the first to third compensation data DD_C1 to DD_C3 may be values respectively corresponding to brightness to be expressed through the first to third pixels PX1 to PX3; in the display operation of the pixel, the first to third decoding voltages VDEC1 to VDEC3 respectively corresponding to the first to third compensation data DD_C1 to DD_C3 may be provided to the first to third pixels PX1 to PX3, respectively. When the mode signal MS indicates the sensing operation of the pixel, the first to third selection circuits MUX1 to MUX3 may select and output the sensing reference voltage VP.

FIGS. 6 to 9 are diagrams for describing a display operation and a sensing operation of a column control block of FIG. 5. For brevity of illustration and for convenience of description, components that are unnecessary to describe the display operation and the sensing operation may be omitted. In an example embodiment, an operation of the column control block 100 associated with the display operation of the pixel will be described with reference to FIG. 6, and an operation of the column control block 100 associated with the sensing operation of the pixel will be described with reference to FIGS. 7 to 9.

Referring to FIGS. 1 and 5 to 9, depending on the switching operation of the switching circuit 110, the column control block 100 may use the source drivers SD1 to SD3 as a data driving circuit configured to control pixels of the display panel 11, or may use the source drivers SD1 to SD3 as an amplifier or an integrator configured to receive the pixel information PI from the pixels of the display panel 11.

Figure 6:
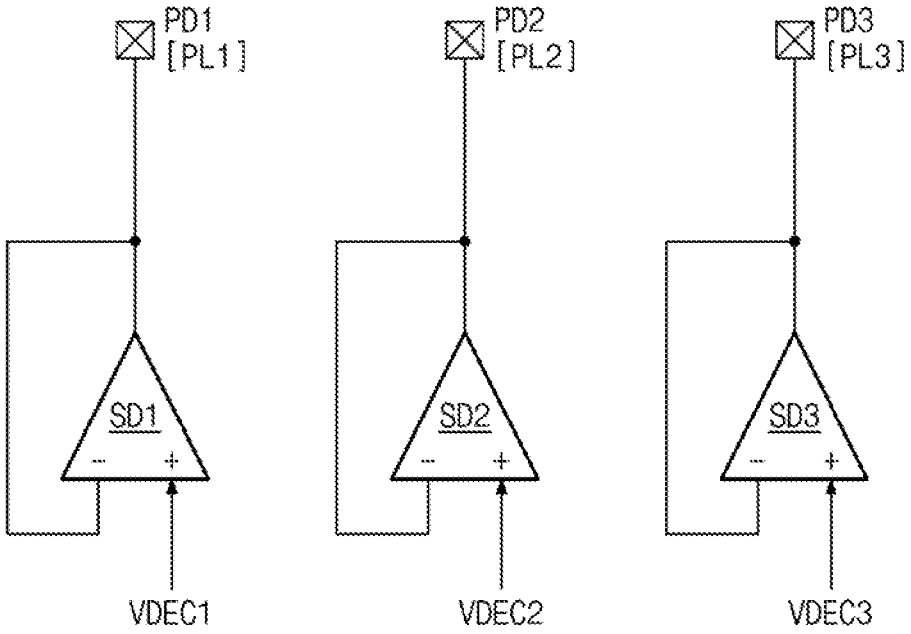
FIGS. 6 to 9 are diagrams for describing a display operation and a sensing operation of a column control block of FIG. 5.

For example, in the display operation of the pixel, as illustrated in FIG. 6, the output terminals of the first to third source drivers SD1 to SD3 of the column control block 100 may be respectively connected with the first to third pads PD1 to PD3, and the output terminals of the first to third source drivers SD1 to SD3 may be fed back to the inverting input terminals of the first to third source drivers SD1 to SD3. The first to third selection circuits MUX1 to MUX3 may perform a selection operation such that the first to third decoding voltages VDEC1 to VDEC3 are applied to the non-inverting input terminals of the first to third source drivers SD1 to SD3. In an example embodiment, a connection relationship of the first to third source drivers SD1 to SD3 and the first to third pads PD1 to PD3 illustrated in FIG. 6 may be implemented by the switching operation of the switching circuit 110.

In the display operation illustrated in FIG. 6, the first source driver SD1 may amplify the first decoding voltage VDEC1 and may output the amplified voltage to the first pixel line PL1. The second source driver SD2 may amplify the second decoding voltage VDEC2 and may output the amplified voltage to the second pixel line PL2. The third source driver SD3 may amplify the third decoding voltage VDEC3 and may output the amplified voltage to the third pixel line PL3. Thus, in the display operation, the first to third source drivers SD1 to SD3 may be used as a data driving circuit configured to amplify the first to third decoding voltages VDEC1 to VDEC3 and to output the amplified voltages through the first to third pixel lines PL1 to PL3.

Figure 7:
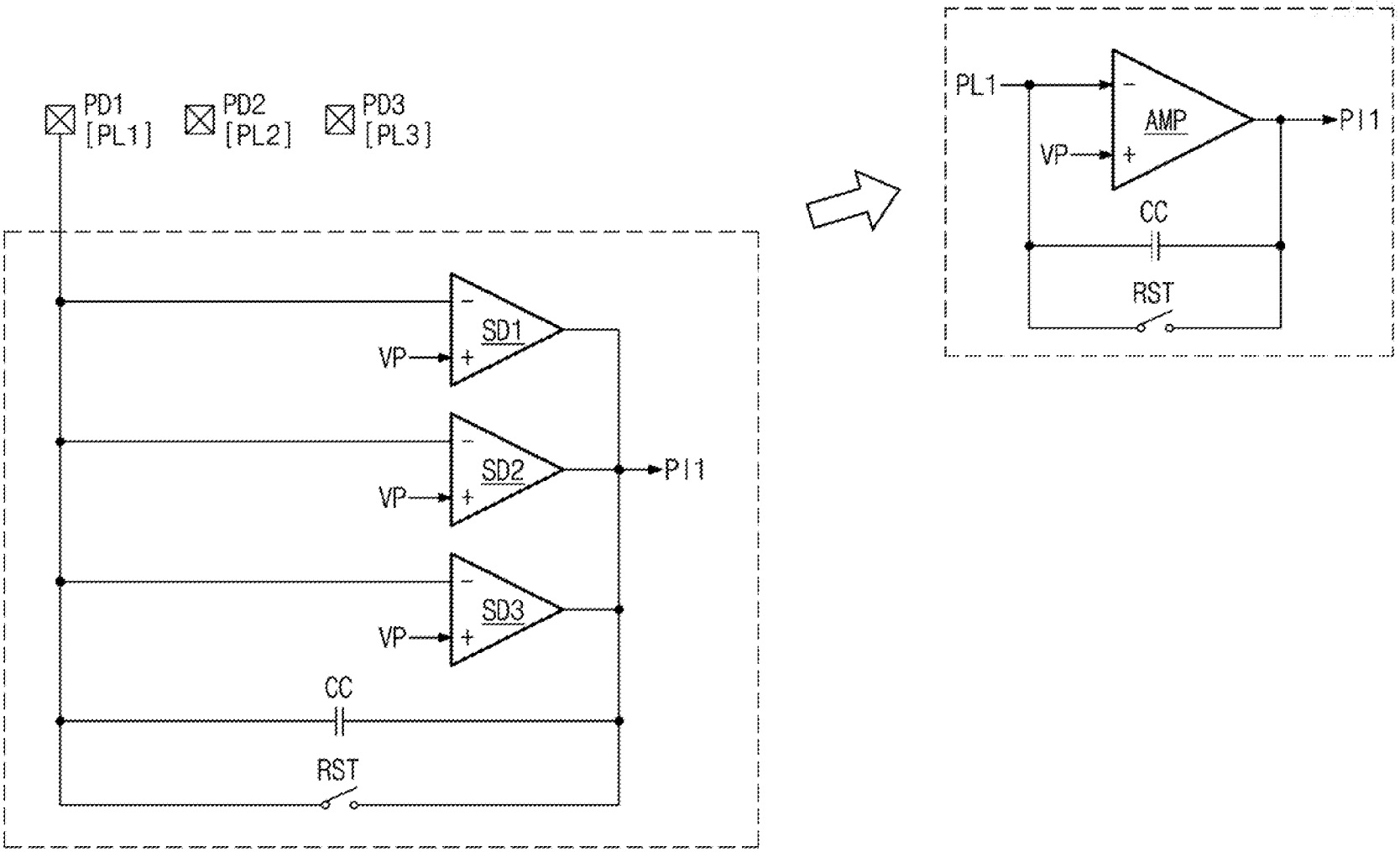
Figure 8:
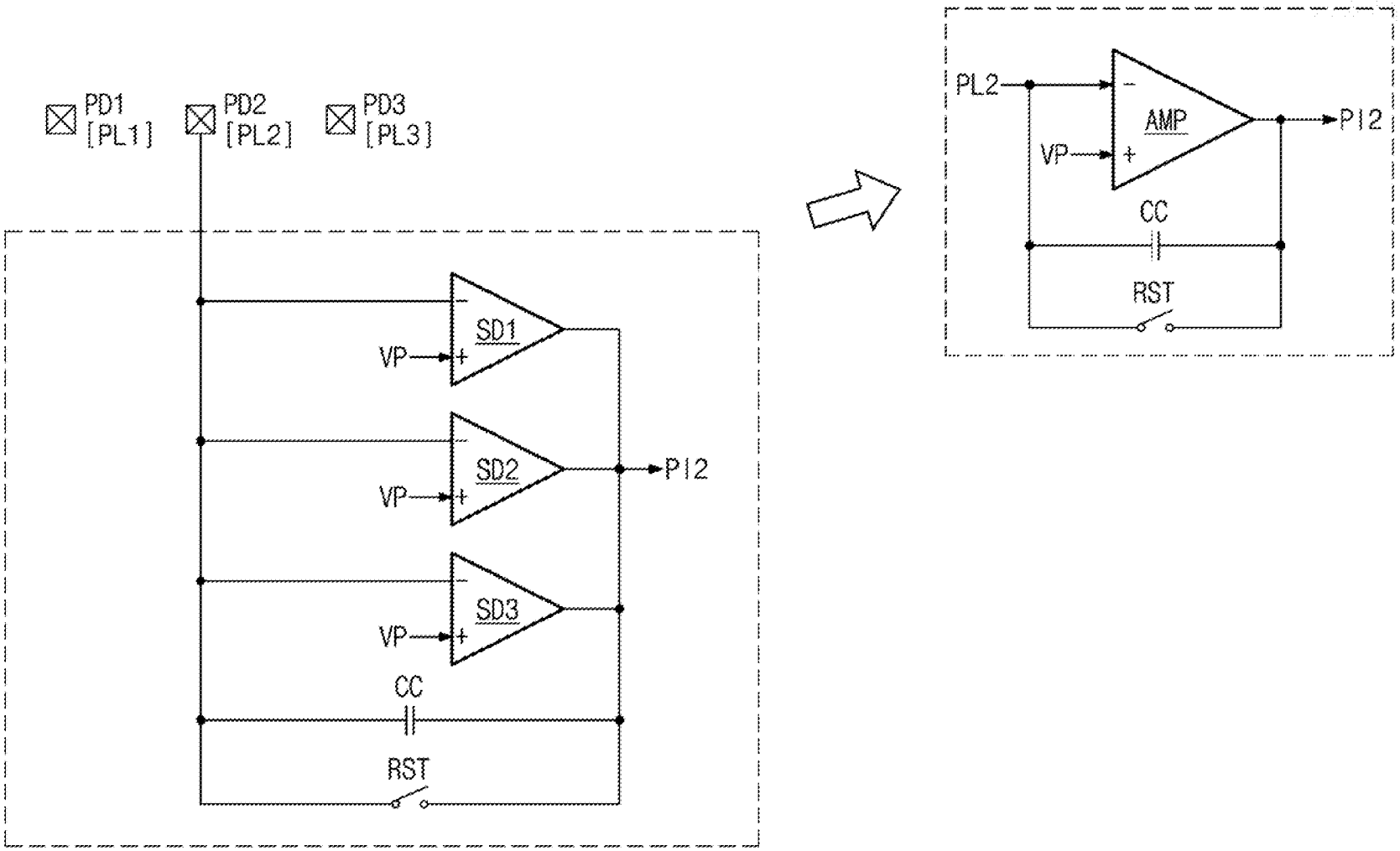
Figure 9:
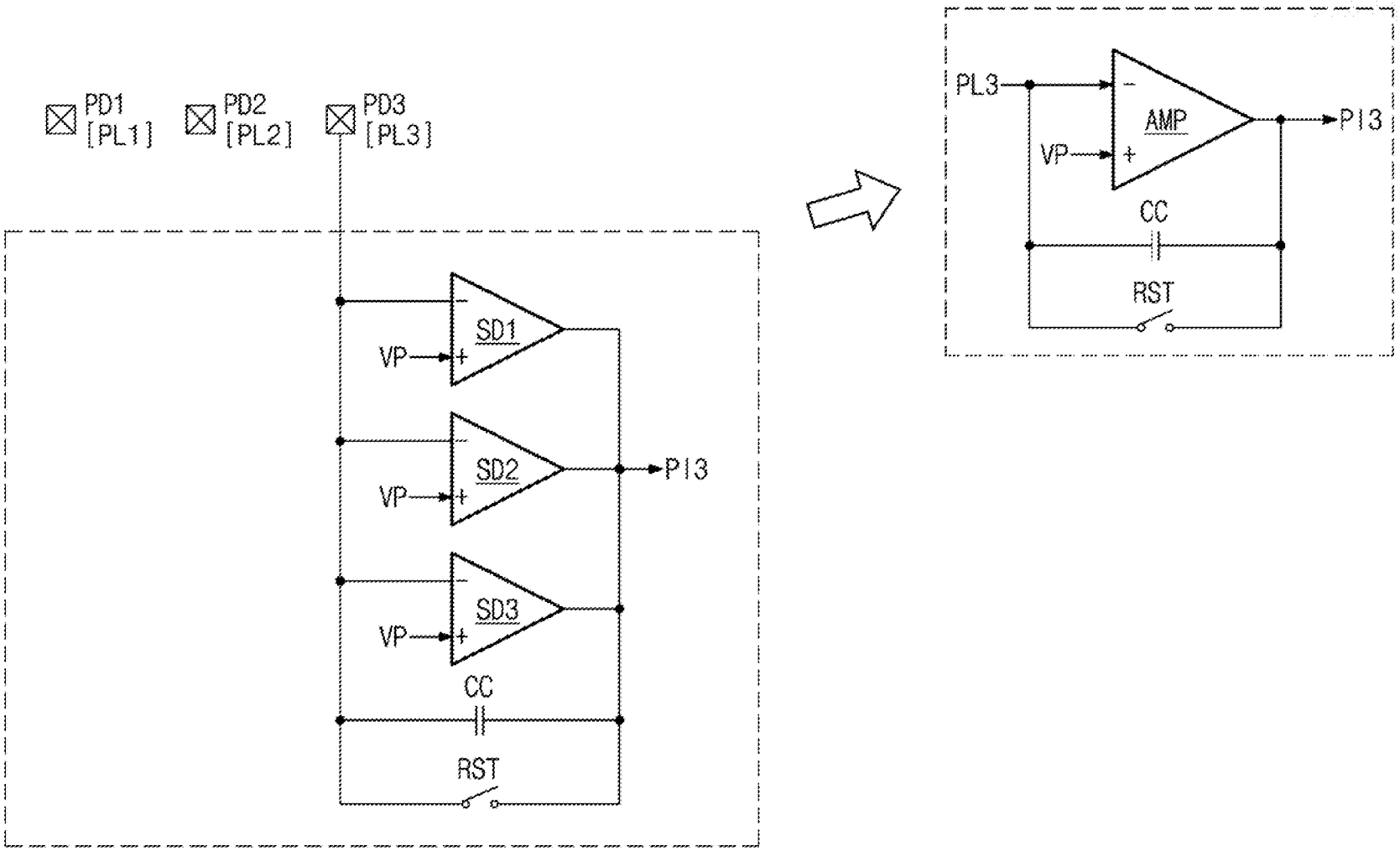

Then, in the sensing operation of the pixel, the column control block 100 may be configured in the form of a circuit illustrated in FIGS. 7 to 9. For example, in the sensing operation of the pixel connected with the first pixel line PL1 of the first pad PD1, as illustrated in FIG. 7, the inverting input terminals of the first to third source drivers SD1 to SD3 may be connected with the first pad PD1, and the output terminals thereof may be connected with a node from which first pixel information PI1 is output. The sensing reference voltage VP may be applied to the non-inverting input terminals of the first to third source drivers SD1 to SD3. A capacitor CC and a reset switch RST may be connected in parallel between the inverting input terminals and the output terminals of the first to third source drivers SD1 to SD3. Thus, in the sensing operation of the pixel PX1 connected with the first pixel line PL1, an equivalent of one low-noise amplifier AMP may be used, as the first to third source drivers SD1 to SD3 are connected in parallel or are merged; the first pixel information PI1 may be sensed from the pixel PX1 connected with the first pixel line PL1 using the first to third source drivers SD1 to SD3.

Likewise, in the sensing operation of the pixel PX2 connected with the second pixel line PL2, as illustrated in FIG. 8, the inverting input terminals of the first to third source drivers SD1 to SD3 may be connected with the second pad PD2, and the output terminals thereof may be connected with a node from which second pixel information PI2 is output. The sensing reference voltage VP may be applied to the non-inverting input terminals of the first to third source drivers SD1 to SD3. The capacitor CC and the reset switch RST may be connected in parallel between the inverting input terminals and the output terminals of the first to third source drivers SD1 to SD3. Thus, in the sensing operation of the pixel PX2 connected with the second pixel line PL2, an equivalent of one low-noise amplifier AMP may be used, as the first to third source drivers SD1 to SD3 are connected in parallel or are merged; the second pixel information PI2 may be sensed from the pixel PX2 connected with the second pixel line PL2 using the first to third source drivers SD1 to SD3.

Likewise, in the sensing operation of the pixel PX3 connected with the third pixel line PL3, as illustrated in FIG. 9, the inverting input terminals of the first to third source drivers SD1 to SD3 may be connected with the third pad PD3, and the output terminals thereof may be connected with a node from which third pixel information PI3 is output. The sensing reference voltage VP may be applied to the non-inverting input terminals of the first to third source drivers SD1 to SD3. The capacitor CC and the reset switch RST may be connected in parallel between the inverting input terminals and the output terminals of the first to third source drivers SD1 to SD3. Thus, in the sensing operation of the pixel PX3 connected with the third pixel line PL3, the equivalent of one low-noise amplifier AMP may be used, as the first to third source drivers SD1 to SD3 are connected in parallel or are merged; the third pixel information PI3 may be sensed from the pixel PX3 connected with the third pixel line PL3 using the first to third source drivers SD1 to SD3.

The connection configurations between source drivers and pads described with reference to FIGS. 6 to 9 may be implemented by the switching operation of the switching circuit 110. A configuration of the switching circuit 110 and a configuration and an operation of the reset switch RST will be more fully described with reference to FIGS. 13 to 14D.

As described above, a display driving integrated circuit according to an example embodiment may receive pixel information from a corresponding pixel using at least one source driver configured to control the pixel, in the sensing operation of the pixel. Accordingly, because a separate low-noise amplifier for receiving pixel information may be omitted, the size and costs of the display driving integrated circuit may be reduced.

Figure 10:
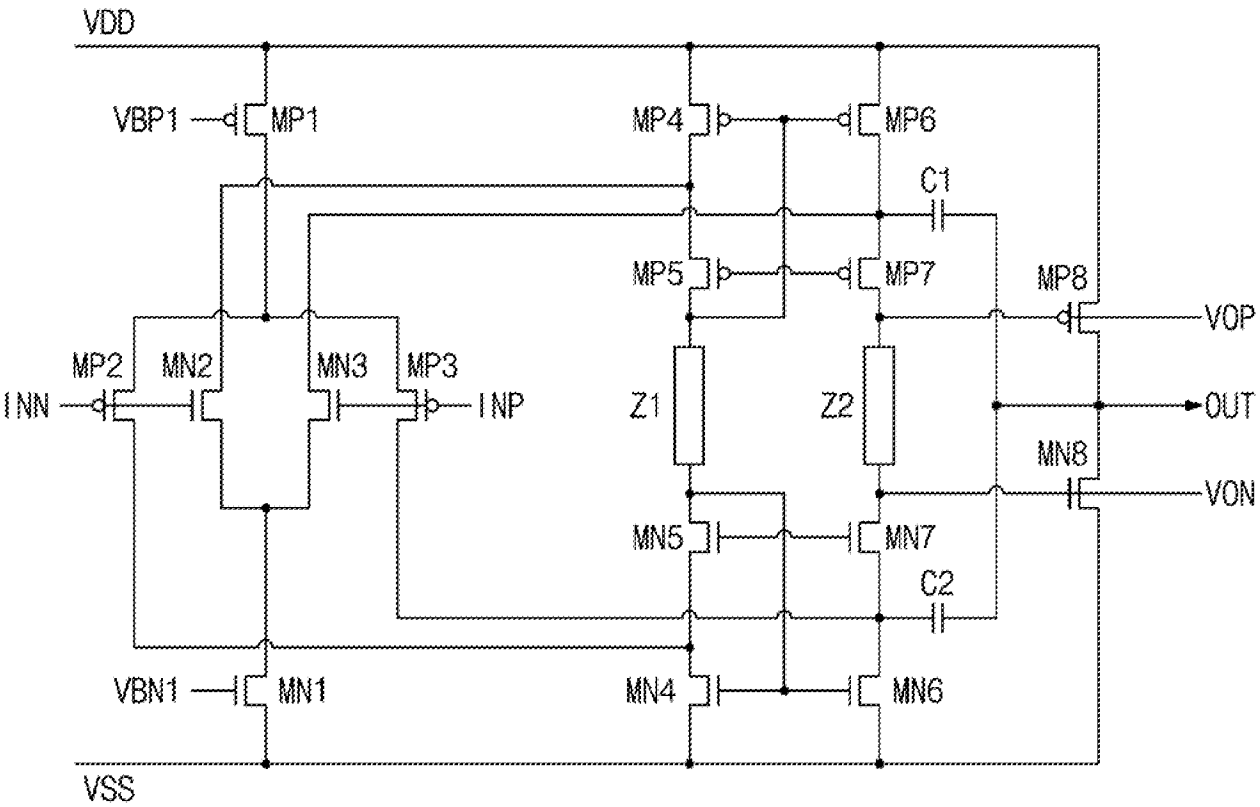
FIG. 10 is a circuit diagram illustrating a first source driver of a plurality of source drivers included in a column control block according to an example embodiment.

FIG. 10 is a circuit diagram illustrating a first source driver of a plurality of source drivers included in a column control block according to an example embodiment. An example circuit diagram of the first source driver SD1 will be described with reference to FIG. 10, but, for example, each of a plurality of source drivers may have a structure equal or similar to a structure of the first source driver SD1 or may have a structure different from the structure illustrated in FIG. 10.

Referring to FIG. 10, the first source driver SD1 may include a plurality of PMOS transistors MP1 to MP8 and a plurality of NMOS transistors MN1 to MN8. In the circuit diagram illustrated in FIG. 10, a transistor polarity (e.g., P-channel or N-channel) and a transistor type are merely examples.

The first PMOS transistor MP1 may be connected between a power supply voltage VDD and the second PMOS transistor MP2, and may operate in response to a bias voltage VBP1. The second PMOS transistor MP2 may be connected between the first PMOS transistor MP1 and the fourth NMOS transistor MN4, and may operate in response to an inverted input signal INN. The inverted input signal INN may be a signal input to the inverting input terminal of the first source driver SD1. The third PMOS transistor MP3 may be connected between the first PMOS transistor MP1 and the sixth NMOS transistor MN6, and may operate in response to a non-inverting input signal INP. The non-inverting input signal INP may be a signal input to the non-inverting input terminal of the first source driver SD1.

The first NMOS transistor MN1 may be connected between the second NMOS transistor MN2 and a ground voltage VSS, and may operate in response to a bias voltage VBN1. The second NMOS transistor MN2 may be connected between the fourth PMOS transistor MP4 and the first NMOS transistor MN1, and may operate in response to the inverted input signal INN. The third NMOS transistor MN3 may be connected between the sixth PMOS transistor MP6 and the first NMOS transistor MN1, and may operate in response to the non-inverting input signal INP.

The fourth PMOS transistor MP4 may be connected between the power supply voltage VDD and the fifth PMOS transistor MP5, and may operate in response to a gate of the sixth PMOS transistor MP6. The fifth PMOS transistor MP5 may be connected between the fourth PMOS transistor MP4 and a first impedance circuit Z1, and may operate in response to a gate of the seventh PMOS transistor MP7.

The fourth NMOS transistor MN4 may be connected between the fifth NMOS transistor MN5 and the ground voltage VSS, and may operate in response to a gate of the sixth NMOS transistor MN6. The fifth NMOS transistor MN5 may be connected between the first impedance circuit Z1 and the fourth NMOS transistor MN4, and may operate in response to a gate of the seventh NMOS transistor MN7.

The sixth PMOS transistor MP6 may be connected between the power supply voltage VDD and the seventh PMOS transistor MP7, and may operate in response to a gate of the fourth PMOS transistor MP4. In an example embodiment, the gates of the fourth and sixth PMOS transistors MP4 and MP6 may be connected with a node between the fifth PMOS transistor MP5 and the first impedance circuit Z1. The seventh PMOS transistor MP7 may be connected between the sixth PMOS transistor MP6 and a second impedance circuit Z2, and may operate in response to a gate of the fifth PMOS transistor MP5.

The sixth NMOS transistor MN6 may be connected between the seventh NMOS transistor MN7 and the ground voltage VSS, and may operate in response to a gate of the fourth NMOS transistor MN4. In an example embodiment, the gates of the fourth and sixth NMOS transistors MN4 and MN6 may be connected with a node between the first impedance circuit Z1 and the fifth NMOS transistor MN5. The seventh NMOS transistor MN7 may be connected between the second impedance circuit Z2 and the sixth NMOS transistor MN6 and may operate in response to a gate of the fifth NMOS transistor MN5.

A first capacitor C1 may be connected between a node between the sixth and seventh PMOS transistors MP6 and MP7 and an output node from which an output signal OUT is output. A second capacitor C2 may be connected between a node between the sixth and seventh NMOS transistors MN6 and MN7 and the output node from which the output signal OUT is output.

The eighth PMOS transistor MP8 may be connected between the power supply voltage VDD and the output node, and may operate in response to a node between the seventh PMOS transistor MP7 and the second impedance circuit Z2. The eighth NMOS transistor MN8 may be connected between the output node and the ground voltage VSS, and may operate in response to a node between the second impedance circuit Z2 and the seventh NMOS transistor MN7. In an example embodiment, a gate of the eighth PMOS transistor MP8 may be a first internal node VOP, and a gate of the eighth NMOS transistor MN8 may be a second internal node VON.

As understood from the circuit diagram of FIG. 10, the first source driver SD1 may amplify a difference between the non-inverting input signal INP and the inverted input signal INN, and may output the amplified difference as the output signal OUT.

Figure 11A:
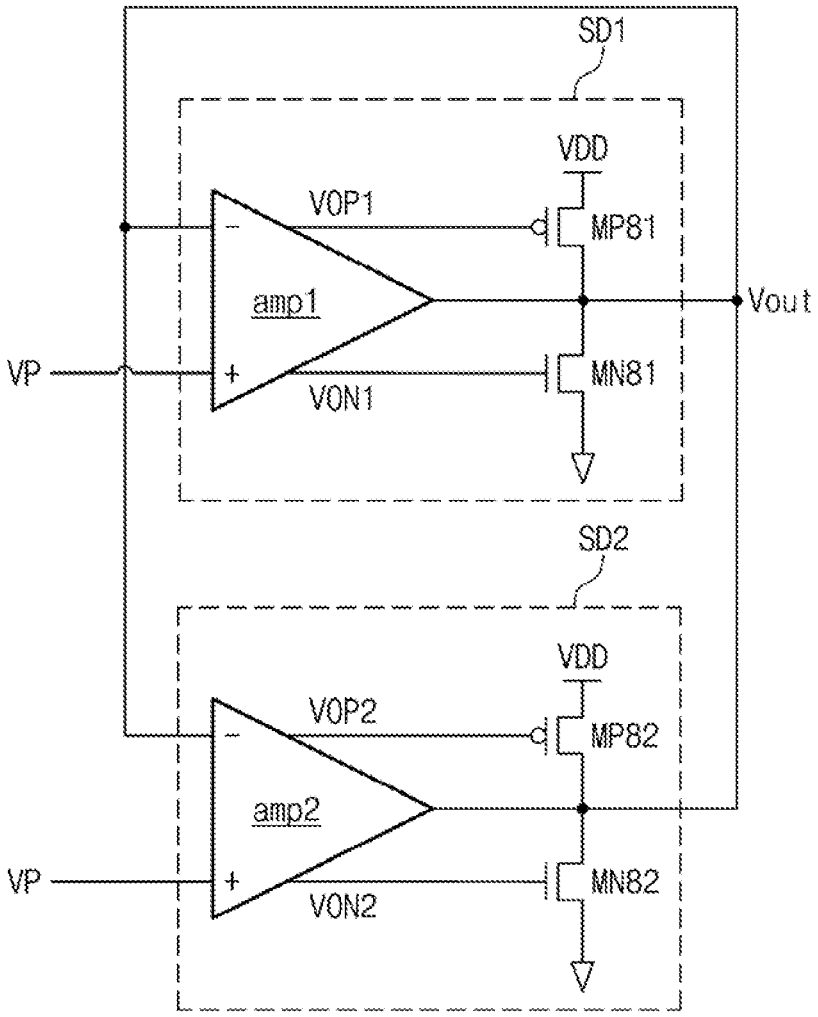
FIGS. 11A and 11B are diagrams for describing a way to implement a low-noise amplifier through a parallel connection or merging of a plurality of source drivers.
Figure 11B:
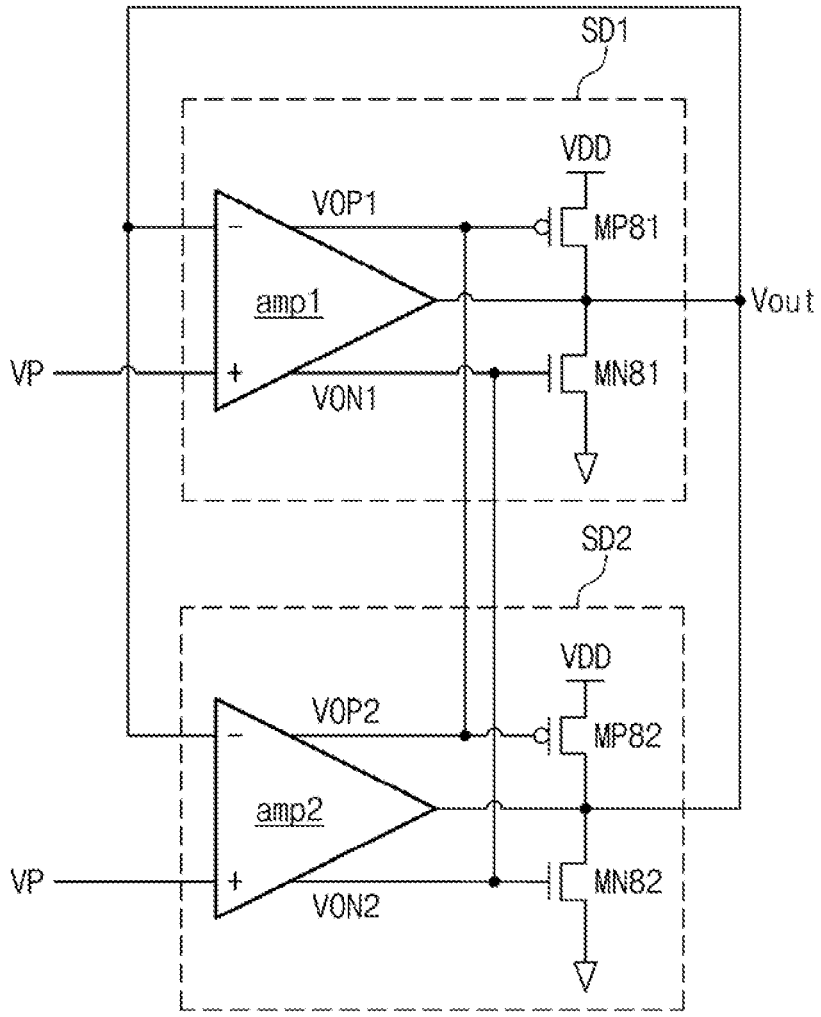

FIGS. 11A and 11B are diagrams illustrating implementations of a low-noise amplifier through a parallel connection or merging of a plurality of source drivers. For brevity of illustration and for convenience of description, an embodiment in which two source drivers SD1 and SD2 are connected in parallel or merged to implement one low-noise amplifier is described, but it will be understood that the number of source drivers to be merged to implement one low-noise amplifier may be varied.

Referring to FIGS. 5, 11A, and 11B, the column control block 100 may include the first and second source drivers SD1 and SD2. The first source driver SD1 may include a first amplifier amp1 and transistors MP81 and MN81. The transistors MP81 and MN81 may be connected in series between the power supply voltage VDD and the ground voltage VSS, and may operate in response to internal nodes VOP1 and VON1. The second source driver SD2 may include a second amplifier amp2 and transistors MP82 and MN82. The transistors MP82 and MN82 may be connected in series between the power supply voltage VDD and the ground voltage VSS, and may operate in response to internal nodes VOP2 and VON2.

In an example embodiment, each of the first and second source drivers SD1 and SD2 may have the configuration of the circuit diagram described with reference to FIG. 10. In an example embodiment, the transistors MP81, MN81, MP82, and MN82 may be a part (e.g., MP8 and MN8) of transistors described with reference to FIG. 10.

As described above, for the sensing operation of the pixel, the column control block 100 may implement one low-noise amplifier by connecting the plurality of source drivers in parallel. For example, as illustrated in FIG. 11A, the first and second source drivers SD1 and SD2 may be connected in parallel or may be merged. Thus, the output terminals (i.e., a terminal or a node from which an output voltage Vout is output) and the inverting input terminals of the first and second source drivers SD1 and SD2 may be electrically connected. In an example embodiment, the electrical connection of the output terminals and the inverting input terminals of the first and second source drivers SD1 and SD2 may be made by the switching circuit 110 described above.

In another implementation, the first and second source drivers SD1 and SD2 may be connected in parallel or may be merged as illustrated in FIG. 11B. Thus, the output terminals and the inverting input terminals of the first and second source drivers SD1 and SD2 may be electrically connected, and the internal nodes VOP1, VON1, VOP2, and VON2 of the first and second source drivers SD1 and SD2 may be electrically interconnected.

Figure 12A:
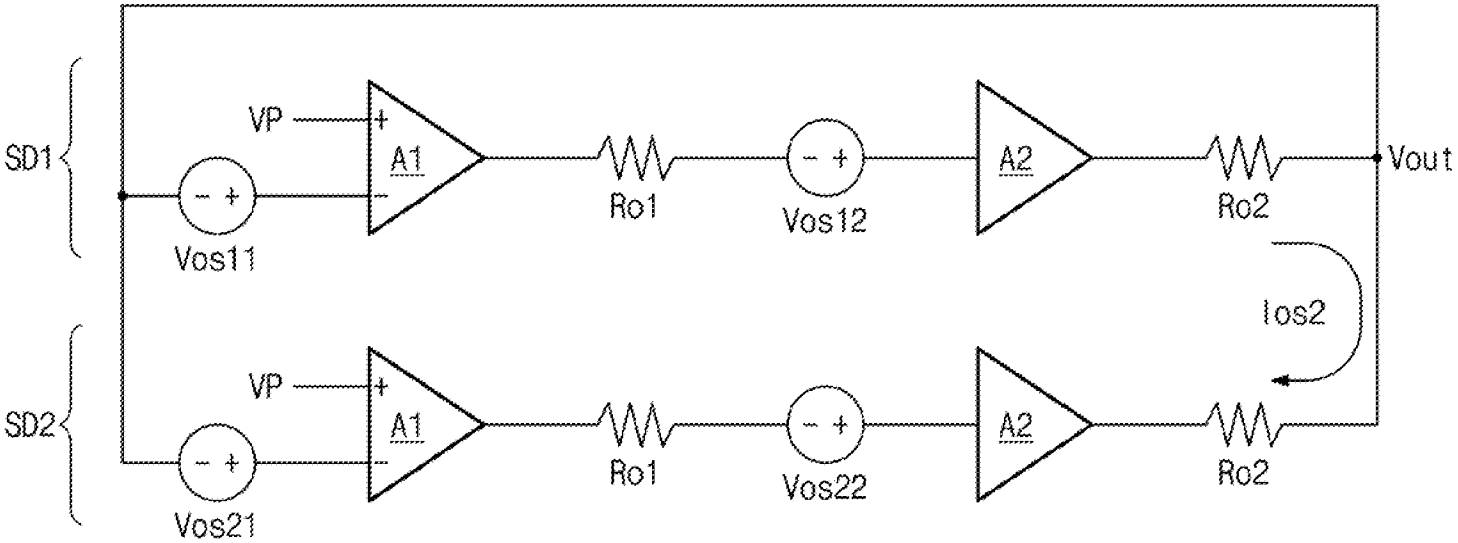
FIGS. 12A and 12B are diagrams illustrating equivalent circuits of parallel-connected source drivers of FIGS. 11A and 11B.
Figure 12B:
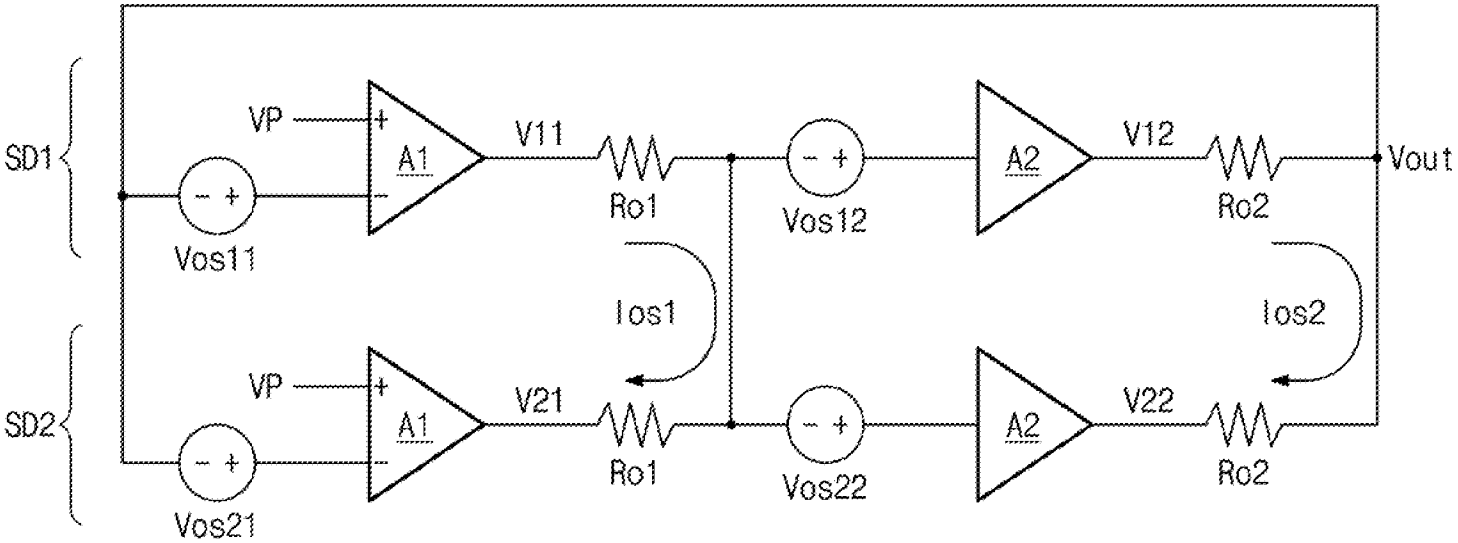

FIGS. 12A and 12B are diagrams illustrating equivalent circuits of parallel-connected source drivers of FIGS. 11A and 11B. Referring to FIGS. 11A and 12A, a circuit configuration according to the embodiment of FIG. 11A, that is, a circuit configuration according to an embodiment where the input terminals and the output terminals of the first and second source drivers SD1 and SD2 are connected in parallel, may be expressed by an equivalent circuit of FIG. 12A.

For example, the first source driver SD1 may be modeled as an amplifier having a first amplification gain A1 and an amplifier having a second amplification gain A2. An inverting input terminal of the amplifier having the first amplification gain A1 may receive the output voltage Vout, and a non-inverting input terminal thereof may receive the sensing reference voltage VP. An output of the amplifier having the first amplification gain A1 may be provided to an input of the amplifier having the second amplification gain A2. In this case, a first offset voltage Vos11 may appear at the inverting input terminal of the amplifier having the first amplification gain A1, and a first offset resistance Ro1 and a second offset voltage Vos12 may appear between the amplifier having the first amplification gain A1 and the amplifier having the second amplification gain A2. A second offset resistance Ro2 may appear at an output of the amplifier having the second amplification gain A2. The second source driver SD2 may be modeled to be similar in shape to the first source driver SD1, and thus, additional description will be omitted to avoid redundancy. For convenience of description, it is assumed that internal parameters (i.e., an offset resistance and an amplification gain) of the first and second source drivers SD1 and SD2 are equal, although some parameters (e.g., the offset voltages Vos21 and Vos22) are marked by different reference signs.

Referring to FIGS. 11B and 12B, a circuit configuration according to the embodiment of FIG. 11B, that is, a circuit configuration according to an embodiment where the input terminals and the output terminals of the first and second source drivers SD1 and SD2 are connected in parallel or merged, may be expressed by an equivalent circuit of FIG. 12B. The equivalent circuit illustrated in FIG. 12B is similar to the equivalent circuit of FIG. 12A except that a node between the first offset resistance Ro1 and the offset voltage Vos12 of the first source driver SD1 and a node between the first offset resistance Ro1 and the offset voltage Vos22 of the second source driver SD2 are electrically connected, and thus, additional description may be made with reference to the above description of FIG. 12B and Equations 1 and 2, below.

In an example embodiment, the output voltage Vout and an offset current Ios2 at the output node according to the equivalent circuit of FIG. 12A may be expressed by Equation 1 below.

$$V_{12} = A_2(A_1(V_P - (V_{out} + V_{OS11})) + V_{OS12}) \qquad \text{[Equation 1]}$$

$$V_{22} = A_2(A_1(V_P - (V_{out} + V_{OS21})) + V_{OS22})$$

$$V_{out} = \frac{V_{12} + V_{22}}{2} = A_1A_2\left(V_P - V_{out} - \frac{V_{OS11} + V_{OS21}}{2}\right) + A_2\frac{V_{OS12} + V_{OS22}}{2}$$

$$V_{out} = \frac{A_1A_2}{1 + A_1A_2}\left(V_P - \frac{V_{OS11} + V_{OS21}}{2}\right) + \frac{A_2}{1 + A_1A_2}\frac{V_{OS12} + V_{OS22}}{2} \approx V_P - \frac{V_{OS11} + V_{OS21}}{2}$$

$$I_{OS2} = \frac{V_{21} - V_{22}}{2R_{O2}} \approx \frac{A_1A_2(V_{OS21} - V_{OS11})}{2R_{O2}}$$

In Equation 1 above, "V12" indicates a voltage of an output node of the amplifier having the second amplification gain A2 of the first source driver SD1, and "V22" indicates a voltage of an output node of the amplifier having the second amplification gain A2 of the second source driver SD2. The remaining reference signs are described above, and thus, additional description will be omitted to avoid redundancy.

In an example embodiment, the output voltage Vout and an offset current Ios2 at the output node according to the equivalent circuit of FIG. 12B may be expressed by Equation 2 below.

$$V_{11} = A_1(V_P - (V_{out} + V_{OS11})) \qquad \text{[Equation 2]}$$

-continued $$V_{21} = A_1(V_P - (V_{out} + V_{OS21}))$$

$$I_{OS1} = \frac{V_{11} - V_{12}}{2R_{O1}} = \frac{A_1(V_{OS11} - V_{OS21})}{2}$$

$$V_1 = \frac{A_1}{2}(V_P - (V_{out} + V_{OS11}) + V_p - (V_{out} + V_{OS21}))$$

$$V_{12} = A_2(V_1 + V_{OS12})$$

$$V_{22} = A_2(V_1 + V_{OS22})$$

$$V_{OUT} = A_1A_2\left(V_P - V_{OUT} - \frac{V_{OS11} + V_{OS21}}{2}\right) + A_2\frac{V_{OS12} + V_{OS22}}{2} \approx V_P - \frac{V_{OS11} + V_{OS21}}{2}$$

$$I_{OS2} = \frac{V_{21} - V_{22}}{2} = \frac{A_2(V_{OS12} - V_{OS22})}{2R_{O2}}$$

In Equation 2 above, "V11" indicates an output level of the amplifier having the first amplification gain A1 of the first source driver SD1, and "V21" indicates an output level of the amplifier having the first amplification gain A1 of the second source driver SD2. The remaining reference signs are described above or illustrated in FIG. 12B, and thus, additional description will be omitted to avoid redundancy.

As understood from Equation 1 and Equation 2 above, the output voltages Vout of the equivalent circuits of FIGS. 12A and 12B are substantially equal. However, in the case where the internal nodes of the first and second source drivers SD1 and SD2 are connected as illustrated in FIG. 12B, an offset current due to the amplifier having the first amplification gain A1 may be attenuated. For example, as understood from Equation 2, in the embodiment of FIG. 12B, a second offset voltage Vos2 having an influence on an output node (i.e., a node from which the output voltage Vout is output) may not be affected by the influence of the first amplification gain A1. Thus, the magnitude of the second offset current Ios2 may be attenuated.

Figure 13:
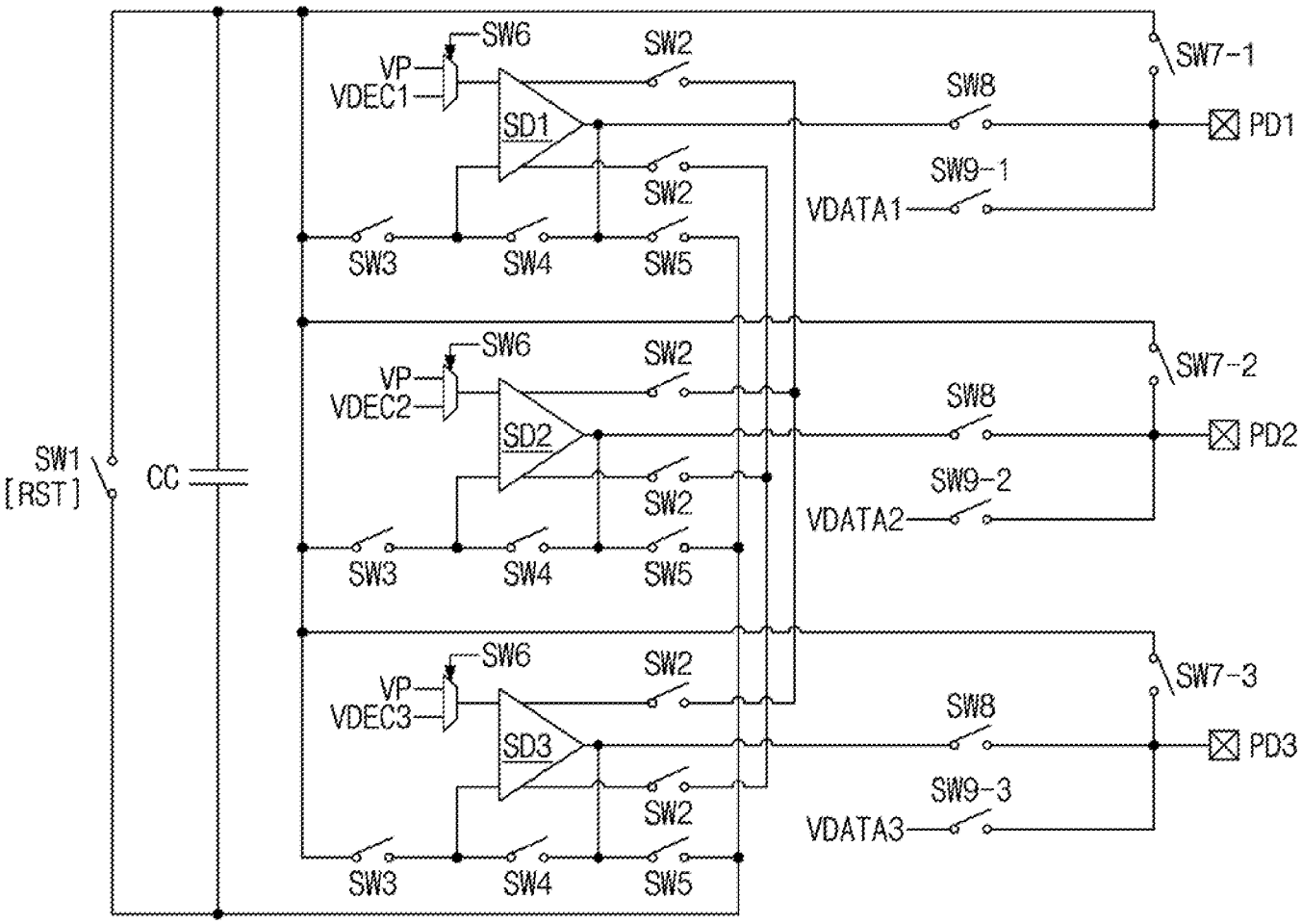
FIG. 13 is a circuit diagram illustrating a column control block of FIG. 5 in detail.

FIG. 13 is a circuit diagram illustrating a column control block of FIG. 5 in detail. For brevity of illustration, reference signs associated with the switching circuit 110 may be omitted. Is will be understood that other components or switches besides those for the first to third source drivers SD1 to SD3 included in the column control block 100 of FIG. 5 may be included in the switching circuit 110. For brevity of illustration, switching signals for controlling a plurality of switches may be omitted, but it will be understood that, for example, the switching signals for controlling the plurality of switches may be included in the mode signal MS or may be generated depending on the mode signal MS.

Referring to FIGS. 5 and 13, the column control block 100 may include the first to third source drivers SD1 to SD3, a plurality of switches SW1 to SW9-3, and the capacitor CC. Below, to avoid undue description that may obscure understanding, detail of a connection relationship of the plurality of switches SW1 to SW9-3 may be omitted, and functions of the plurality of switches SW1 to SW9-3 are mainly described. However, it may be understood that the first to third source drivers SD1 to SD3, the plurality of switches SW1 to SW9-3, and the capacitor CC are connected as illustrated in FIG. 13 or may be connected in various manners so as to implement functions described below.

Referring to FIGS. 5 and 13, the capacitor CC may be connected between the inverting input terminals and the output terminals of the first to third source drivers SD1 to SD3 in the sensing operation.

In each of the first to third source drivers SD1 to SD3, the first switch SW1 may be the reset switch RST described with reference to FIGS. 7 to 9, and may be configured to switch the inverting input terminal and the output terminal of the corresponding first to third source drivers SD1 to SD3 in the sensing operation.

The second switches SW2 may be internal node connection switches configured to connect, in parallel, or merge internal nodes of the first to third source drivers SD1 to SD3 in the sensing operation. In an example embodiment, the second switches SW2 may be omitted depending on how the first to third source drivers SD1 to SD3 are connected.

The third switch SW3 may be a sensing feedback switch configured to connect the output terminal of the corresponding first to third source driver SD1 to SD3 with the inverting input terminal of the corresponding first to third source driver SD1 to SD3 in the sensing operation.

The fourth switch SW4 may be a display feedback switch configured to connect the output terminal and the inverting input terminal of the corresponding first to third source driver SD1 to SD3 in the display operation.

The fifth switch SW5 may be a sensing output switch configured to connect the output terminal of the corresponding first to third source driver SD1 to SD3 in the sensing operation.

The sixth switch SW6 may be a selection switch configured to select signals to be provided to the non-inverting input terminal of the corresponding first to third source driver SD1 to SD3. In an example embodiment, the sixth switch SW6 may correspond to the corresponding selection circuit MUX1 to MUX3 of FIG. 5, respectively. Thus, each sixth switch SW6 may be configured to select either the sensing reference voltage VP or the corresponding decoding voltage (i.e., a respective one of VDEC1, VDEC2, or VDEC3) depending on an operating mode (e.g., the sensing operation or the display operation).

The seventh switch SW7-1 may be a sensing input switch configured to connect the first pad PD1 with the inverting input terminal of the first source driver SD1 in the sensing operation. The seventh switch SW7-2 may be a sensing input switch configured to connect the second pad PD2 with the inverting input terminal of the second source driver SD2 in the sensing operation. The seventh switch SW7-3 may be a sensing input switch configured to connect the third pad PD3 with the inverting input terminal of the third source driver SD3 in the sensing operation.

The eighth switch SW8 may be a display output switches configured to connect the output terminal of the corresponding first to third source driver SD1 to SD3 with the first to third pad PD1 to PD3, respectively, in the display operation.

The ninth switch SW9-1 may be a sensing reset switch configured to provide reset data VDATA1 to the first to third pad PD1 to PD3 in the sensing operation. The ninth switch SW9-2 may be a sensing reset switch configured to provide reset data VDATA2 to the second pad PD2 in the sensing operation. The ninth switch SW9-3 may be a sensing reset switch configured to provide reset data VDATA3 to the third pad PD3 in the sensing operation.

As described above, each of the plurality of switches SW1 to SW9-3 included in the column control block 100 may be selectively turned on or turned off depending on the operating mode (e.g., the sensing operation or the display operation), and thus, the first to third source drivers SD1 to SD3 may be connected as described with reference to FIGS. 6 to 9.

Figure 14:
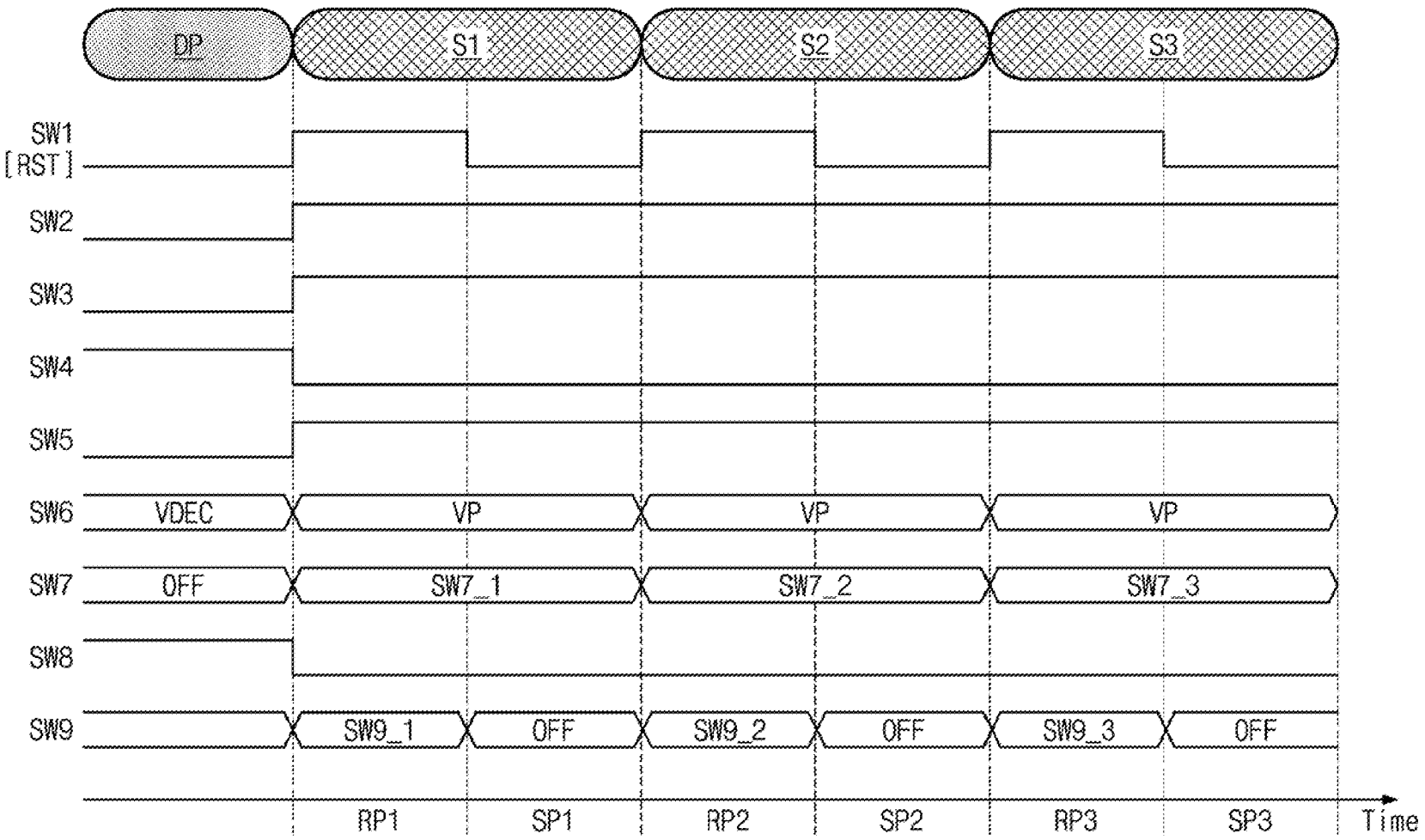
FIG. 14 is a timing diagram for describing an operation of a column control block of FIG. 13.
Figure 15A:
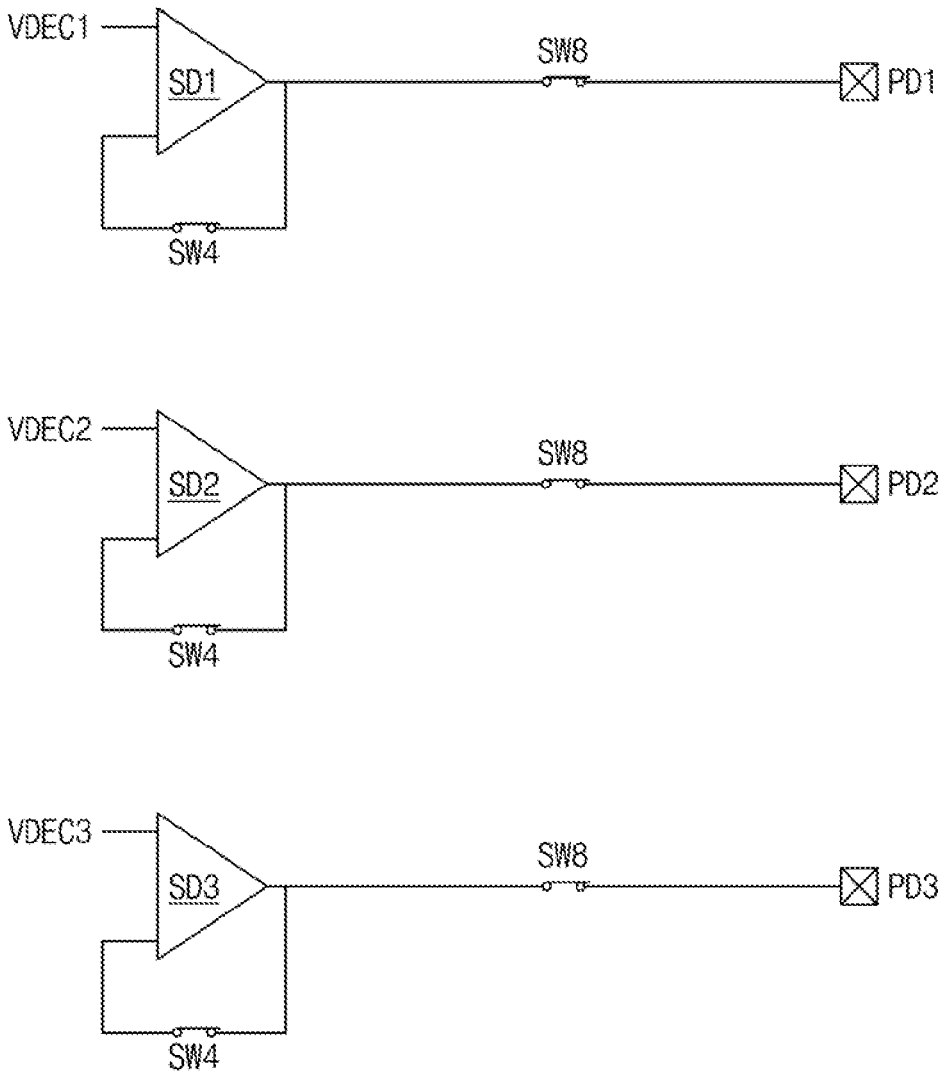
FIGS. 15A to 15C are diagrams illustrating configurations of a column control block according to the timing diagram of FIG. 14.
Figure 15B:
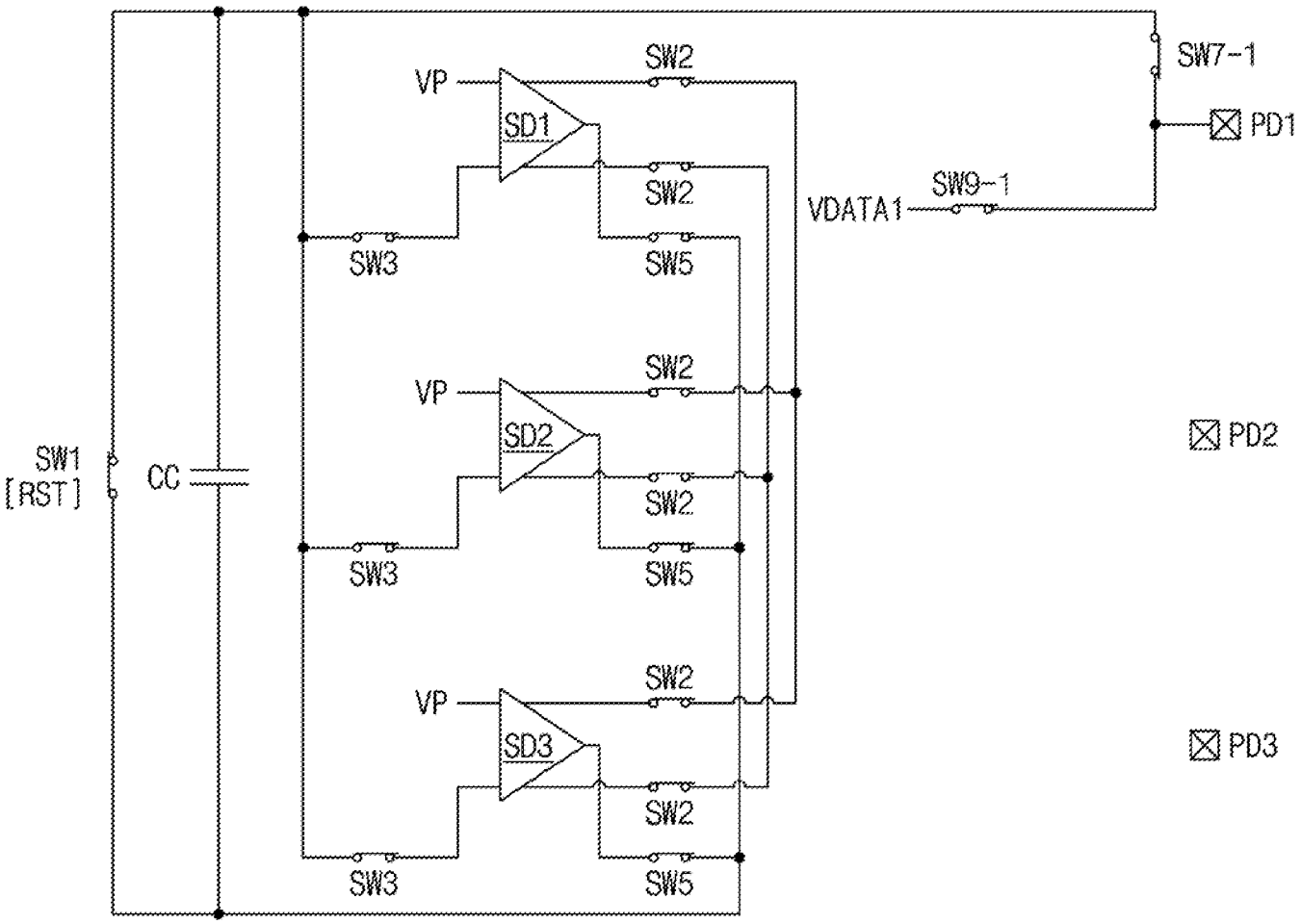
Figure 15C:
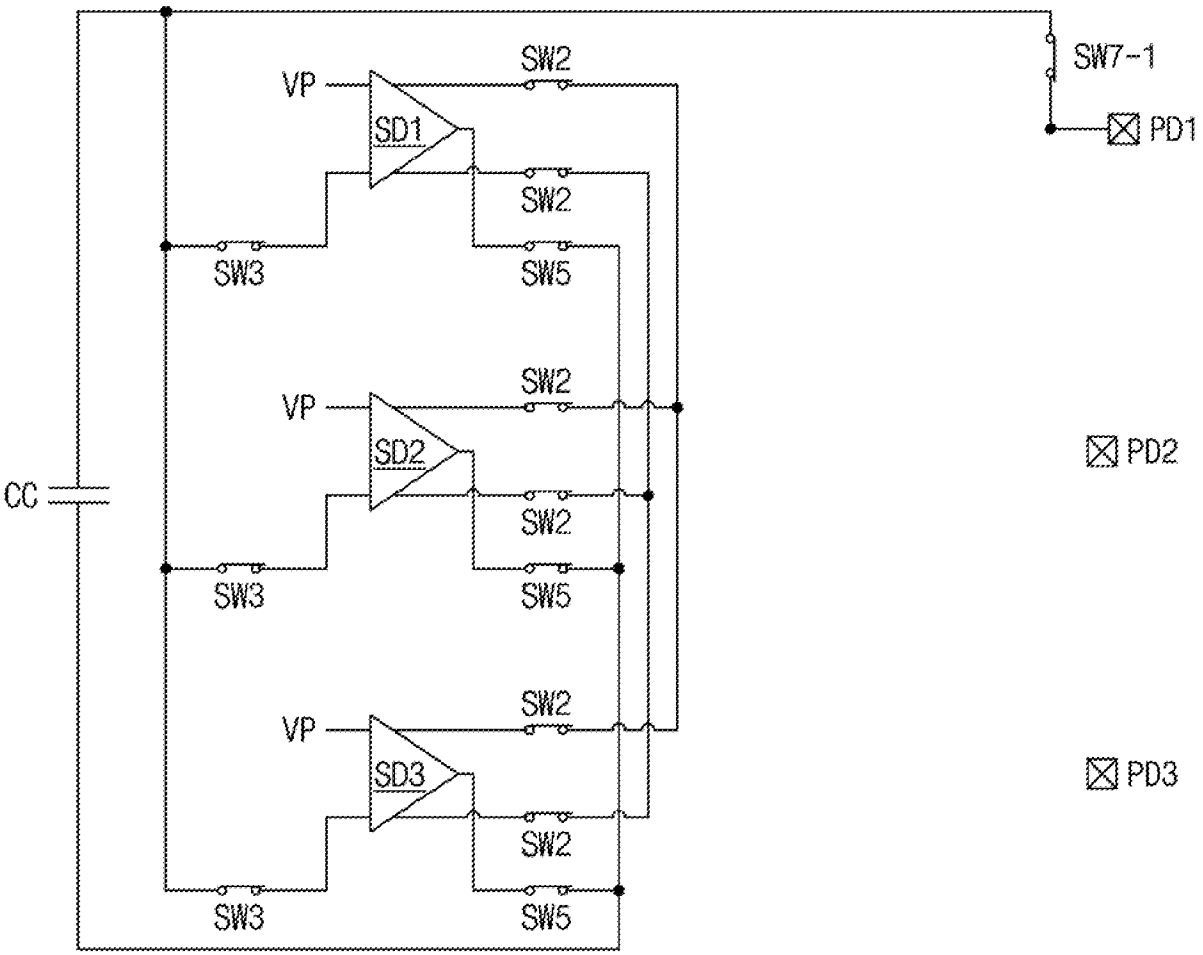

FIG. 14 is a timing diagram for describing an operation of a column control block of FIG. 13. FIGS. 15A to 15C are diagrams illustrating configurations of a column control block according to the timing diagram of FIG. 14. For brevity of illustration, the timing diagram of FIG. 14 is schematically illustrated; in the timing diagram, it is assumed that a high level indicates a turn-on of a switch such that switch is conductive and a low level indicates a turn-off of a switch such that the switch is open or nonconductive. Also, for brevity of illustration, in FIGS. 15A to 15C, turned-on switches are illustrated, while turned-off switches may be omitted.

Referring to FIGS. 1, 13, and 14, the display driving integrated circuit DDI may perform sensing operations S1, S2, and S3 after performing the display operation DP. For example, in the display operation DP, the fourth switches SW4 and the eighth switches SW8 may be turned on, and the sixth switches SW6 may select the decoding voltage VDEC. The remaining switches SW1, SW2, SW3, SW5, SW7-1, SW7-2, SW7-3, SW9-1, SW9-2, and SW9-3 may be turned off.

In this case, the column control block 100 may be implemented as illustrated in FIG. 15A. Thus, the output terminals and the inverting input terminals of the respective first to third source drivers SD1 to SD3 may be connected (i.e., fed back) through the fourth switches SW4, the output terminals of the first to third source drivers SD1 to SD3 may be respectively connected with the first to third pads PD1 to PD3 through the eighth switches SW8, and the first to third decoding voltages VDEC1 to VDEC3 may be respectively provided to the non-inverting input terminals of the first to third source drivers SD1 to SD3 through the sixth switches SW6. Thus, as the fourth switches SW4 and the eighth switches SW8 are turned on and the first to third decoding voltages VDEC1 to VDEC3 are selected by the sixth switches SW6, the first to third source drivers SD1 to SD3 may provide the first to third decoding voltages VDEC1 to VDEC3 to pixels connected with the first to third pads PD1 to PD3, respectively.

After the display operation DP is performed, the first to third sensing operations S1, S2, and S3 shown in FIG. 14 may be performed. The first sensing operation S1 may indicate an operation of sensing pixel information from a pixel connected with the first pad PD1, the second sensing operation S2 may indicate an operation of sensing pixel information from a pixel connected with the second pad PD2, and the third sensing operation S3 may indicate an operation of sensing pixel information from a pixel connected with the third pad PD3.

As illustrated in FIG. 14, the first to third sensing operations S1 to S3 may be divided into respective reset periods RP1 to RP3 and sensing periods SP1 to SP3. For example, the first sensing operation S1 may be divided into the first reset period RP1 and the first sensing period SP1. In the first reset period RP1, the column control block 100 may perform a reset operation by providing the first reset data VDATA1 to the pixel connected with the first pad PD1. In the first sensing period SP1, the column control block 100 may be configured to sense first pixel information PI1 from the pixel connected with the first pad PD1.

In detail, in the first reset period RP1 of the first sensing operation S1, the first switch SW1, the second switches SW2, the third switches SW3, and the fifth switches SW5 may be turned on, the sixth switches SW6 may select the sensing reference voltage VP, one switch SW7-1 of the seventh switches SW7-1 to SW7-3 and a corresponding one switch SW9-1 of the ninth switches SW9-1 to SW9-3 may be turned on, and the remaining switches SW4 and SW8 may be turned off.

In this case, the column control block 100 may be implemented as illustrated in FIG. 15B. Thus, the internal nodes of the first to third source drivers SD1 to SD3 may be connected in parallel through the second switches SW2, and the inverting input terminals and the output terminals of the first to third source drivers SD1 to SD3 may be connected through the third switches SW3 and the fifth switches SW5. The first pad PD1 may be connected with the inverting input terminals of the first to third source drivers SD1 to SD3 through one switch SW7-1 of the seventh switches SW7-1 to SW7-3, and the first reset data VDATA1 may be provided to the first pad PD1 through one switch SW9-1 of the ninth switches SW9-1 to SW9-3. Thus, a specific node (e.g., the first node n1 of FIG. 2A) of the pixel connected with the first pad PD1 may be reset to a level corresponding to the first reset data VDATA1 through one switch SW9-1 of the ninth switches SW9-1 to SW9-3. As the first switch SW1 (i.e., the reset switch RST) is turned on, the inverting input terminals and the output terminals of the first to third source drivers SD1 to SD3 may be reset to the level corresponding to the first reset data VDATA1.

Thus, through the reset operation described above, the input/output terminals of the first to third source drivers SD1 to SD3 merged and the specific node of the corresponding pixel may be reset.

Afterwards, in the first sensing period SP1 of the first sensing operation S1, one switch SW9-1 of the ninth switches SW9-1 to SW9-3 and the first switch SW1 may be turned off, and the remaining switches may maintain the states in the first reset period RP1.

In this case, the column control block 100 may be implemented as illustrated in FIG. 15C. Thus, pixel information may be received from the specific node of a pixel connected with the first pad PD1 through the first pad PD1, the pixel information may be amplified by the first to third source drivers SD1 to SD3 merged, and the amplified information may be output through the output terminals of the first to third source drivers SD1 to SD3 merged. Thus, as illustrated in FIG. 15C, in the first sensing operation S1, the first to third source drivers SD1 to SD3 may be used as a low-noise amplifier or an integrator configured to sense pixel information.

In an example embodiment, the reset level of the input/output terminals of the first to third source drivers SD1 to SD3 merged through the first reset period RP1 and the pixel information sensed in the first sensing period SP1 may be provided to the analog-to-digital converter 15 (refer to FIG. 1). The analog-to-digital converter 15 may perform correlated double sampling on each of the reset level and the pixel information to output the sensing data DS.

The second reset period RP2 and the second sensing period SP2 of the second sensing operation S2, and the third reset period RP3 and the third sensing period SP3 of the third sensing operation S3 are similar to the first reset period RP1 and the first sensing period SP1 of the first sensing operation S1, except that switches turned on from among the seventh switches SW7-1 to SW7-3 and the ninth switches SW9-1 to SW9-3 are different, and thus, additional description will be omitted to avoid redundancy.

In an example embodiment, switching signals illustrated in FIG. 14 may be included in the mode signal MS from the control block 13 or may be generated based on the mode signal MS.

As described above, the display driving integrated circuit DDI according to an example embodiment may use source drivers as a data driving circuit for controlling pixels or as a low-noise amplifier for receiving pixel information from a pixel depending on an operating mode (e.g., a display mode or a sensing mode). Accordingly, because a separate low-noise amplifier for receiving pixel information may be omitted, the size and costs of the display driving integrated circuit DDI may be reduced.

Figure 16:
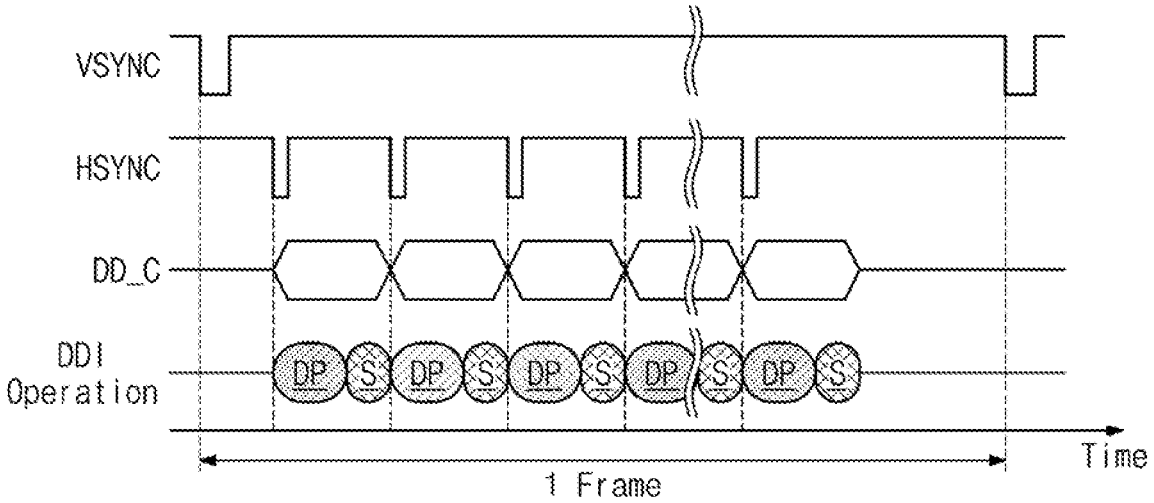
FIG. 16 is a timing diagram for describing an operation of a display driving integrated circuit of FIG. 1.

FIG. 16 is a timing diagram for describing an operation of a display driving integrated circuit of FIG. 1. For convenience of description, components that are unnecessary to describe an operation of the display driving integrated circuit may be omitted, and control signals (e.g., VSYNC and HSYNC) for the operation of the display driving integrated circuit are briefly expressed. For convenience of description, the term "display driving integrated circuit DDI" is used. The display driving integrated circuit DDI may include components that are described with reference to FIG. 1, such as the control block 13, the memory 14, the analog-to-digital converter 15, and the column control block 100.

Referring to FIGS. 1 and 16, the display driving integrated circuit DDI may receive a vertical synchronization signal VSYNC and a horizontal synchronization signal HSYNC from an external device (e.g., an AP, a GPU, or a host device). In response to the received signals VSYNC and HSYNC, the display driving integrated circuit DDI may control the pixels PX of the display panel 11 and may sense the pixel information PI from the pixels PX. Thus, the display driving integrated circuit DDI may perform the display operation DP and the sensing operation "S" on pixels in response to the received signals VSYNC and HSYNC.

For example, the vertical synchronization signal VSYNC may be a signal for determining one frame to be displayed in the display panel 11. The horizontal synchronization signal HSYNC may be a signal for determining a row of pixels displaying information in the display panel 11. The display driving integrated circuit DDI may display one frame through the display panel 11 in synchronization with the vertical synchronization signal VSYNC. The display driving integrated circuit DDI may control rows of pixels displaying information through the display panel 11 in synchronization with the horizontal synchronization signal HSYNC.

In this case, the display driving integrated circuit DDI (or the column control block 100) according to an example embodiment may repeatedly perform the display operation of the pixel and the sensing operation of the pixel every period of the horizontal synchronization signal HSYNC. For example, during a first period of the horizontal synchronization signal HSYNC, the column control block 100 may perform at least one of the display operation DP of pixels at the first row and the sensing operation "S" of at least one of the pixels at the first row.

In an example embodiment, as described with reference to FIGS. 14 and 15A, the display operation DP may be performed by connecting output terminals of a plurality of source drivers with the corresponding pixel lines through the switching circuit 110. As described with reference to FIGS. 14, 15B, and 15C, the sensing operation "S" may be performed as the switching circuit 110 connects the plurality of source drivers in parallel and connects at least one of pixel lines with the input terminals (e.g., inverting input terminals) of the source drivers connected in parallel.

During a second period of the horizontal synchronization signal HSYNC, the column control block 100 may perform at least one of the display operation DP of pixels at the second row and the sensing operation "S" of at least one of the pixels at the second row. Likewise, every period of the horizontal synchronization signal HSYNC, the column control block 100 may perform at least one of the display operation DP of pixels at the corresponding row and the sensing operation "S" of at least one of the pixels at the corresponding row. Thus, the display driving integrated circuit DDI according to an example embodiment may perform the sensing operation on a specific pixel or given pixels while performing the display operation of the pixels. In this case, the display driving integrated circuit DDI may perform the display operation and the sensing operation using the same source drivers.

The timing diagram illustrated in FIG. 16 is an example and may be varied, e.g., the display driving integrated circuit DDI may perform only the sensing operation on a part of rows or a part of pixels, during an operation of displaying one frame (i.e., during one period of the vertical synchronization signal VSYNC).

Figure 17A:
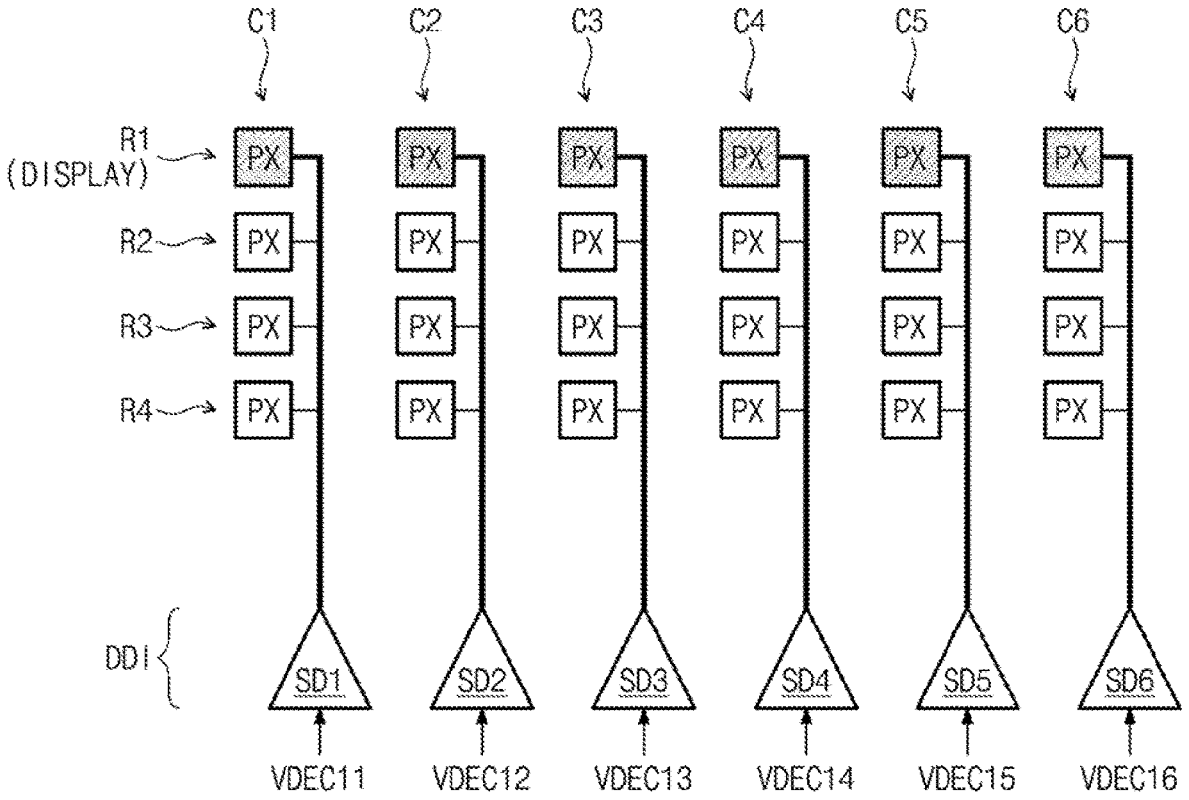
FIGS. 17A and 17B are diagrams for describing a display operation and a sensing operation according to the flowchart of FIG. 16.
Figure 17B:
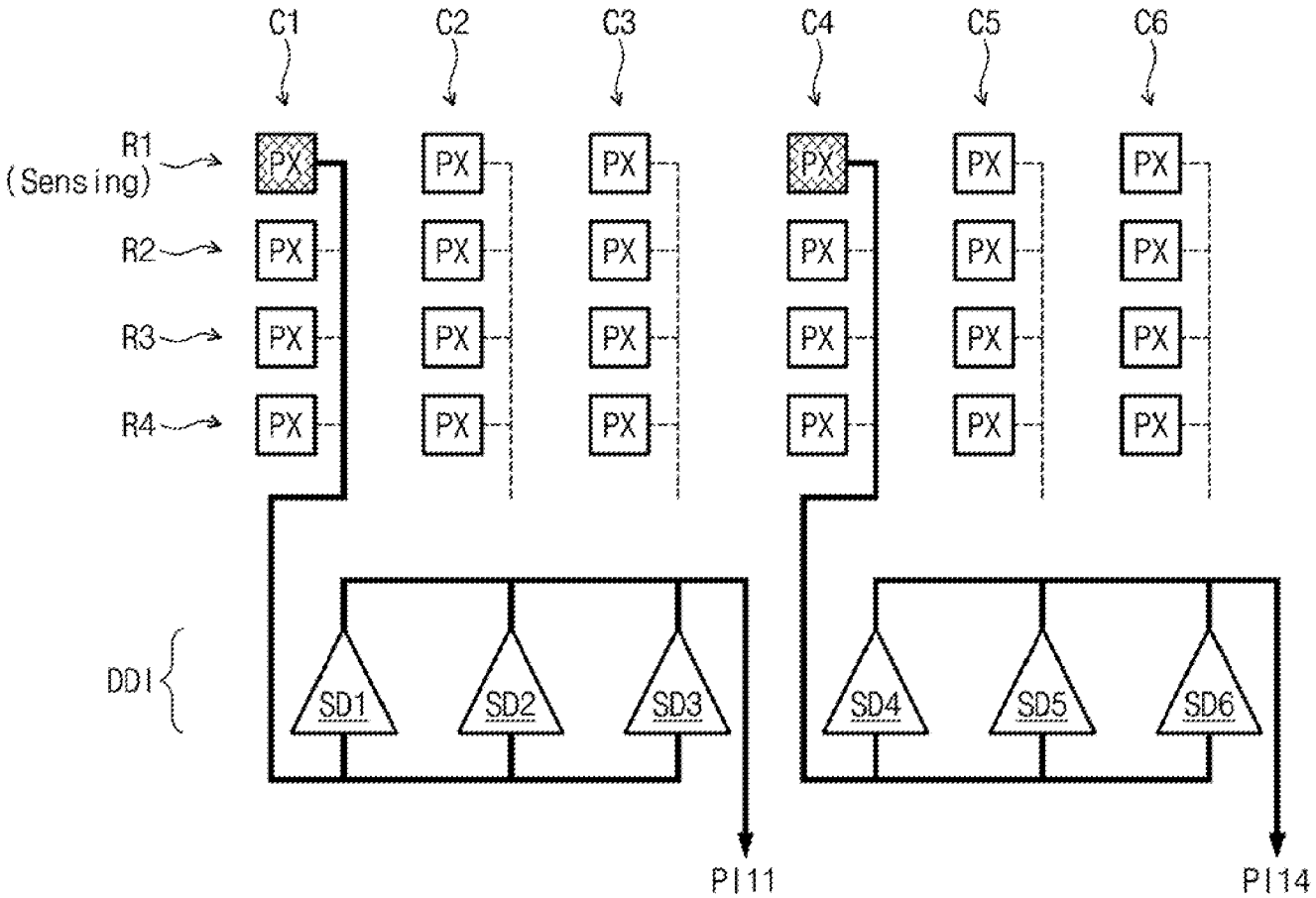

FIGS. 17A and 17B are diagrams for describing a display operation and a sensing operation according to the timing diagram of FIG. 16. For brevity of illustration, components that are unnecessary to describe the display operation and the sensing operation may be omitted, and it is assumed merely for ease of description that the display panel 11 includes 4×6 pixels PX at the first to fourth rows R1 to R4 and the first to sixth columns C1 to C6.

Referring to FIGS. 16 and 17A, the display driving integrated circuit DDI may perform the display operation. For example, the display operation may be performed on pixels at the first row R1. In this case, first to sixth source drivers SD1 to SD6 of the display driving integrated circuit DDI may operate to provide first to sixth decoding voltages VDEC11 to VDEC16 to the pixels PX at the first row R1 and the first to sixth columns C1 to C6. Thus, the first to sixth source drivers SD1 to SD6 may be respectively connected with pixel lines corresponding to the first to sixth columns C1 to C6. This connection may be made by the switching circuit 110.

After the display operation DP is completely performed on the pixels PX at the first row R1, the display driving integrated circuit DDI may perform the sensing operation "S" on some of the pixels at the first row R1. For example, as illustrated in FIG. 17B, the display driving integrated circuit DDI may receive pixel information PI11 and PI14 from the pixels PX at the first row R1 and the first column C1 and the first row R1 and the fourth column C4, respectively. In this case, as described with reference to FIGS. 1 to 15C, the first to third source drivers SD1 to SD3 may be connected in parallel and merged and thus may receive, sense, amplify, or output the pixel information PI11 from the pixel PX at the first row R1 and the first column C1, and the fourth to sixth source drivers SD4 to SD6 may be connected in parallel and merged and thus may receive, sense, amplify, or output the pixel information PI14 from the pixel PX at the first row R1 and the fourth column C4. Thus, in the sensing operation, the first to third source drivers SD1 to SD3 may operate as one low-noise amplifier or an integrator, and the fourth to sixth source drivers SD4 to SD6 may operate as another low-noise amplifier or integrator.

As described above, the display driving integrated circuit DDI according to an example embodiment may perform the display operation and the sensing operation of a pixel using a plurality of source drivers. Accordingly, because a separate low-noise amplifier for the sensing operation of the pixel may not be used, the size of the display driving integrated circuit DDI may be reduced.

In an example embodiment, in the case where the number of source drivers included in the display driving integrated circuit DDI is "a×n" and source drivers are merged in units of "n", through one sensing operation, pixel information may be received, sensed, amplified, or output from each of "a" pixels at the same row. In an example embodiment, a unit by which source drivers are merged, that is, the number of source drivers to be merged to implement one low-noise amplifier may be 30 to 50.

Herein, example embodiments in which a plurality of source drivers are connected in parallel or are merged in the case where the sensing operation of the pixel is performed are described. However, for example, one source driver may be configured to receive pixel information in the sensing operation and to control a pixel in the display operation. In this case, in the sensing operation, a pixel line connected with a pixel may be connected with an inverting input terminal of the source driver, and an output of the source driver may be connected with an analog-to-digital converter. In the display operation, the pixel line connected with the pixel may be connected with an output terminal and an inverting input terminal of the source driver, and the source driver may amplify and output a decoding voltage received through a non-inverting input terminal thereof.

Figure 18:
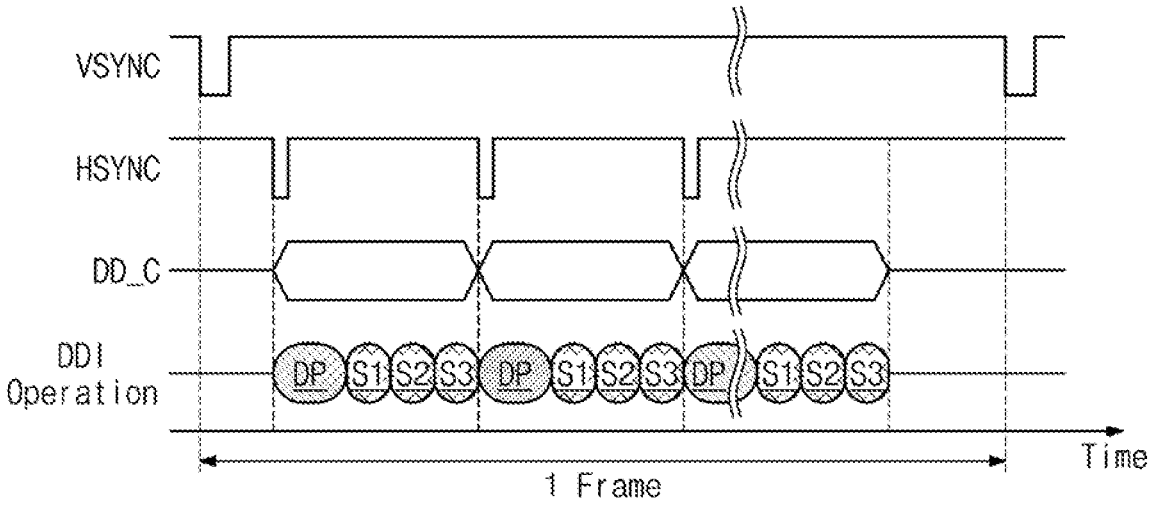
FIG. 18 is a timing diagram for describing an operation of a display driving integrated circuit of FIG. 1.

FIG. 18 is a timing diagram for describing an operation of a display driving integrated circuit of FIG. 1. For convenience of description, additional description associated with the components described above may be omitted to avoid redundancy. Referring to FIGS. 1 and 18, the display driving integrated circuit DDI may perform the display operation DP and the plurality of sensing operations S1 to S3 in one period of the horizontal synchronization signal HSYNC.

In this case, one sensing operation (e.g., the first sensing operation S1) may indicate an operation of sensing pixel information from a given unit of pixels. For example, in the display panel 11, it is assumed that "a×n" pixels are placed at the first row and the number of source drivers for driving the "a×n" pixels is "a×n". In this case, when "n" source drivers are merged to operate as one low-noise amplifier (i.e., a merge unit of source drivers is "n"), pixel information may be sensed from "a" pixels through one sensing operation. In this case, "n" sensing operations may be performed to sense pixel information of all the "a×n" pixels at the first row.

Thus, in one period of the horizontal synchronization signal HSYNC, the display driving integrated circuit DDI may perform one display operation (i.e., an operation of controlling pixels at one row) and a plurality of sensing operations (i.e., sensing operations for sensing pixel information of all pixels at one row).

In another example embodiment, the number of times that the sensing operation is performed in one period of the horizontal synchronization signal HSYNC may be varied or modified. For example, a plurality of sensing operations may be performed on some of pixels at a specific row in one period of the horizontal synchronization signal HSYNC, and a plurality of sensing operations may be performed on the remaining pixels of the pixels at the specific row in one period of the horizontal synchronization signal HSYNC of a next frame (i.e., a next period of the vertical synchronization signal VSYNC). The number of times of the sensing operation of the pixel, a period of the sensing operation of the pixel, or locations of pixels targeted for the sensing operation may be varied or modified depending on an implementation of the display device 10.

Figure 19:
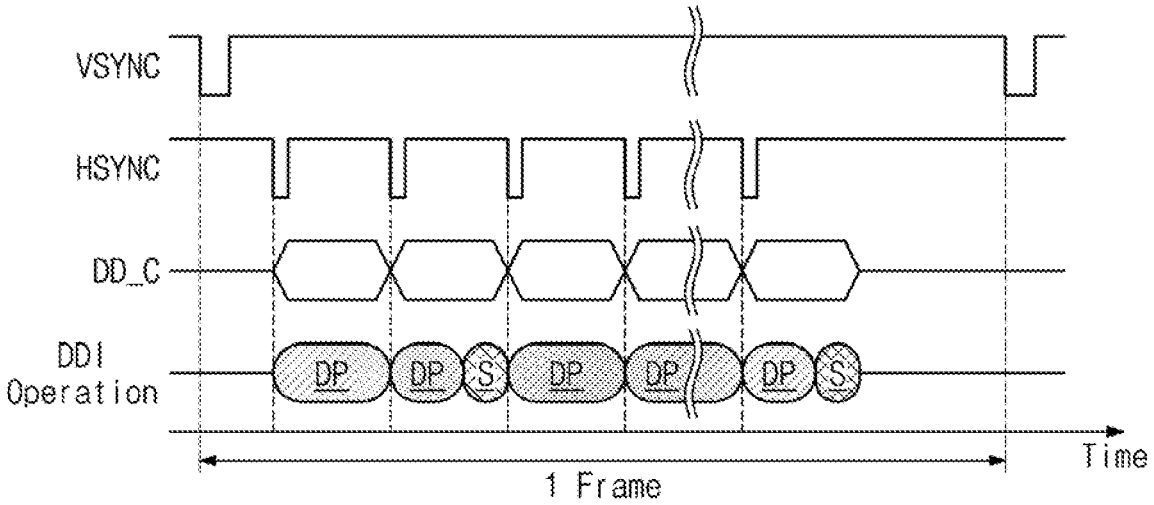
FIG. 19 is a timing diagram for describing an operation of a display driving integrated circuit of FIG. 1.

FIG. 19 is a timing diagram for describing an operation of a display driving integrated circuit of FIG. 1. For convenience of description, additional description associated with the components described above will be omitted to avoid redundancy. Referring to FIGS. 1 and 19, the display driving integrated circuit DDI may perform the display operation DP every period of the horizontal synchronization signal HSYNC and may perform the sensing operation S in some periods of the horizontal synchronization signal HSYNC. For example, in the case where it is desired to sense pixel information from pixels at a specific row, the display driving integrated circuit DDI may perform the sensing operation "S" on all or a part of the pixels at the specific row, in a period of the horizontal synchronization signal HSYNC in which the display operation DP is performed on the specific row. Thus, the display driving integrated circuit DDI may perform the sensing operation only in some periods while displaying one frame.

Figure 20:
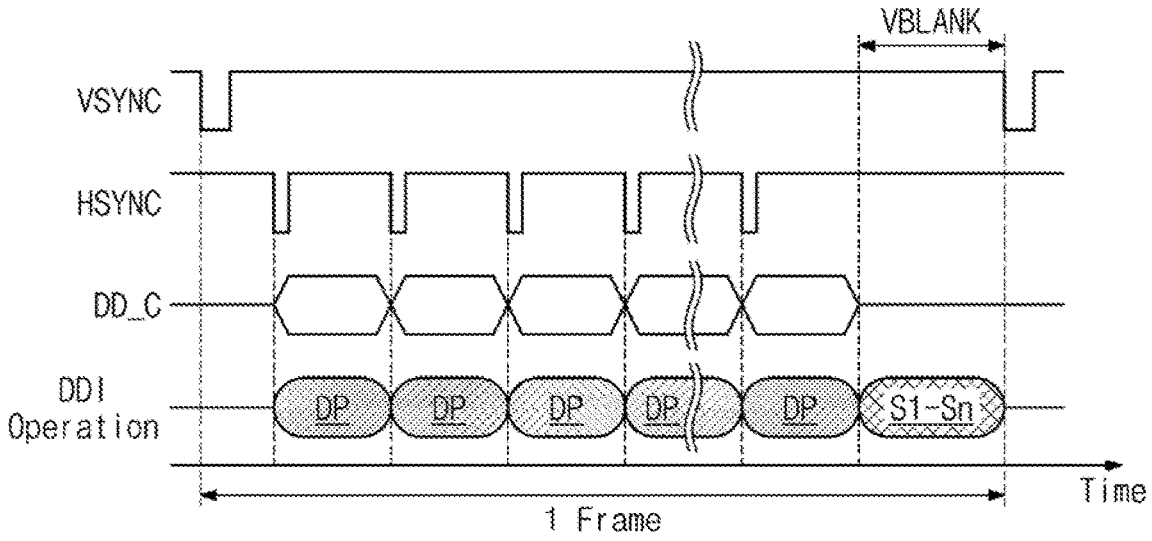
FIG. 20 is a timing diagram for describing an operation of a display driving integrated circuit of FIG. 1.

FIG. 20 is a timing diagram for describing an operation of a display driving integrated circuit of FIG. 1. For convenience of description, additional description associated with the components described above will be omitted to avoid redundancy. Referring to FIGS. 1 and 20, the display driving integrated circuit DDI may perform the display operation DP every period of the horizontal synchronization signal HSYNC. The display driving integrated circuit DDI may perform a plurality of sensing operations S1 to Sn during a vertical blank period VBLANK. For example, the vertical blank period VBLANK may be present from when the display operation DP is completely performed on all rows of the display panel 11 to when a next vertical synchronization signal VSYNC starts to toggle. During the vertical blank period VBLANK, the display driving integrated circuit DDI may perform the plurality of sensing operations S1 to Sn for sensing pixel information from all or a part of the pixels of the display panel 11.

In another example embodiment, a period where the sensing operation is performed, the number of times that the sensing operation is continuously performed, etc. may be varied, or modified depending on an implementation of the display panel 11, a pixel structure, a way to implement the display driving integrated circuit DDI, etc.

Figure 21:
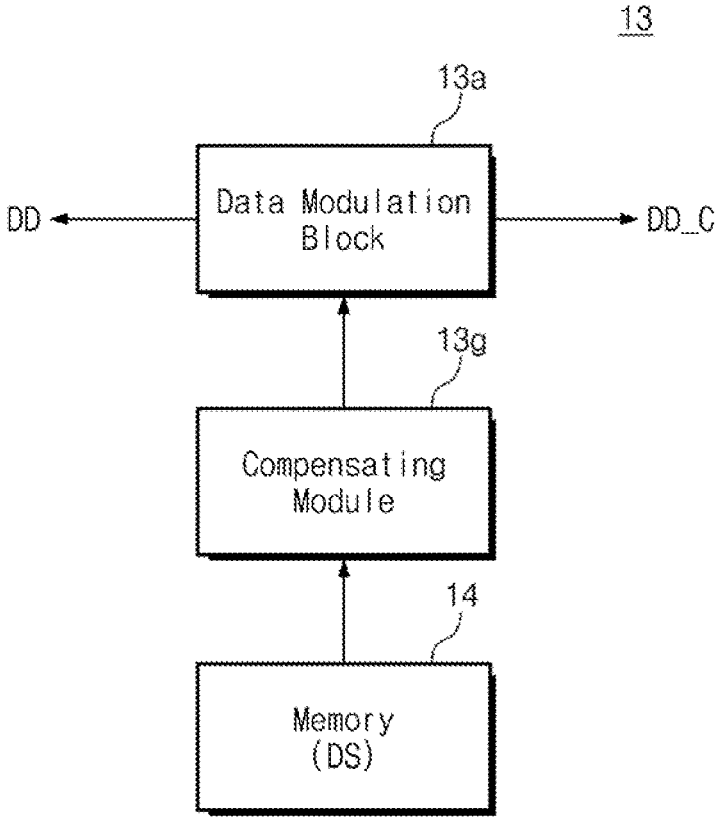
FIG. 21 is a block diagram illustrating a compensation data generating method of a control block of FIG. 1.

FIG. 21 is a block diagram illustrating a compensation data generating method of a control block of FIG. 1. Referring to FIGS. 1 and 21, the memory 14 may store the sensing data DS (i.e., pixel information PI) sensed from a plurality of pixels based on the operation described with reference to FIGS. 1 to 20.

The control block 13 may include a data modulation block 13*a* and a compensating module 13*b*. The compensating module 13*b* may decide a compensation value based on the sensing data DS stored in the memory 14. For example, as described above, the sensing data DS stored in the memory 14 may indicate the pixel information PI about each of the plurality of pixels PX, and the pixel information PI may include information about the degree of degradation of the corresponding pixel (e.g., the degree of degradation of a transistor or the degree of degradation of an organic light-emitting diode). The compensating module 13*b* may decide a compensation value capable of compensating the degradation of the corresponding pixel, based on the sensing data DS.

The data modulation block 13*a* may receive the display data DD from the external device (e.g., an AP, a GPU, or a host device). The data modulation block 13*a* may modulate or compensate the display data DD based on the compensation value decided by the compensating module 13*b* to output the compensation data DD_C. For example, in the case where pixels are controlled solely based on the display data DD provided from the external device, intended brightness may not be expressed due to the degradation of each pixel. In the case where pixels are controlled based on the compensation data DD_C, because the degradation of each pixel is compensated, intended brightness may be expressed from each of the pixels. The data compensation scheme of the control block 13 described above is an example.

Figure 22:
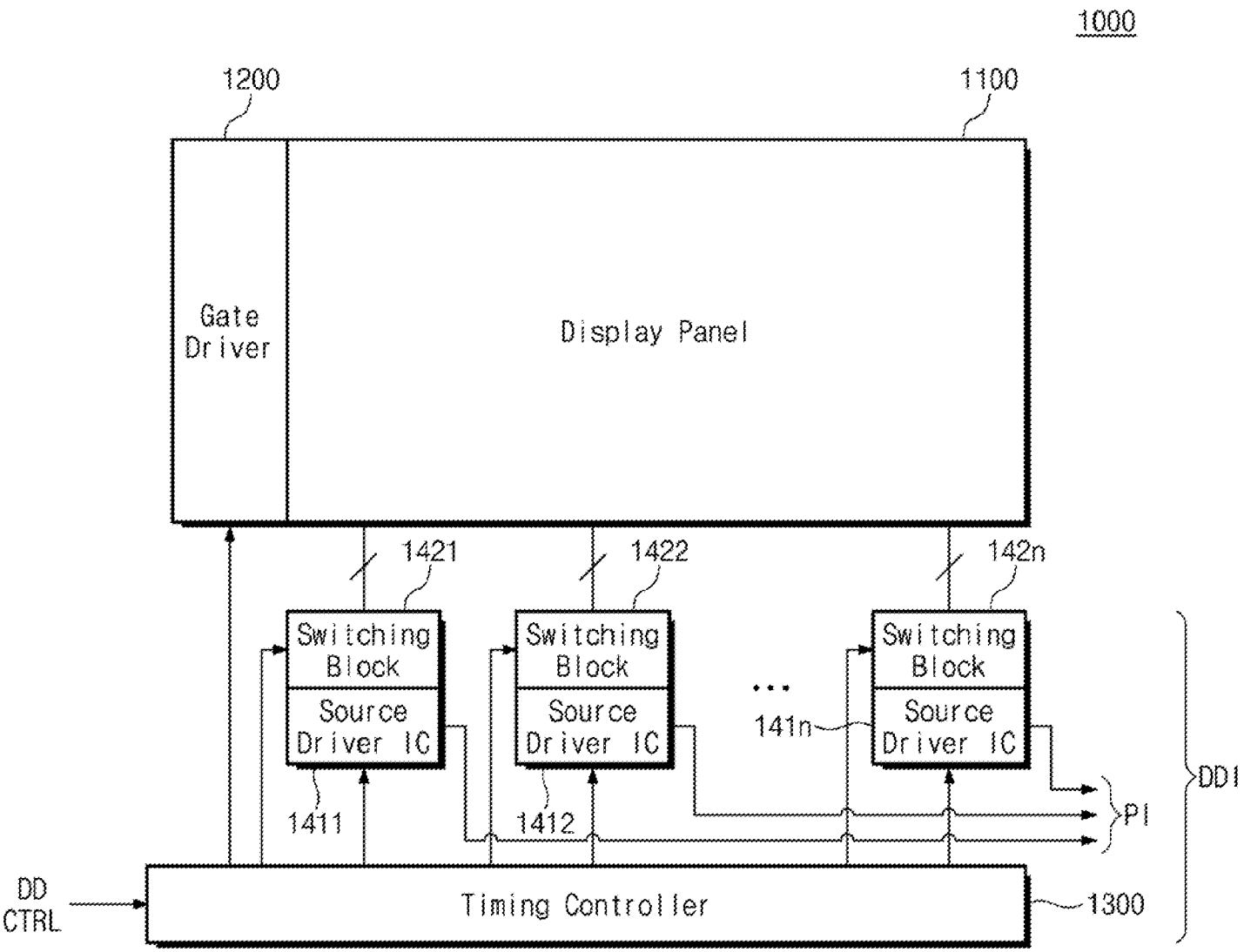
FIG. 22 is a block diagram illustrating a display device according to an example embodiment.

FIG. 22 is a block diagram illustrating a display device according to an example embodiment. For convenience of description, a repeated description of the components described above may be omitted to avoid redundancy. Referring to FIG. 22, a display device 1000 may include a display panel 1100, a gate driver 1200, and the display driving integrated circuit DDI. The display driving integrated circuit DDI may include a timing controller 1300, a plurality of source drivers 1411 to 141*n*, and a plurality of switching blocks 1421 to 142*n*. The display panel 1100, the gate driver 1200, and the timing controller 1300 are above described, and thus, additional description may be omitted to avoid redundancy.

Each of the plurality of source drivers 1411 to 141*n* may include a plurality of source drivers. The plurality of source drivers may be configured to control a plurality of pixels included in the display panel 1100 as described above.

The plurality of switching blocks 1421 to 142*n* may perform a switching operation between the plurality of source drivers 1411 to 141*n* and the display panel 1100. For example, under control of the timing controller 1300, the plurality of switching blocks 1421 to 142*n* may perform switching operations such that the plurality of source drivers included in the plurality of source drivers 1411 to 141*n* control the plurality of pixels of the display panel 1100 or receive the pixel information PI from the plurality of pixels. In an example embodiment, each of the plurality of switching blocks 1421 to 142*n* may be the switching circuit described with reference to FIGS. 1 to 21.

In an example embodiment, in the sensing operation, the plurality of source drivers included in each of the plurality of source drivers 1411 to 141*n* may be merged in a given unit. For example, in the case where the number of source drivers included in one source driver circuit (e.g., 1411) is "a×m", the source drivers may be merged in units of "m". In this case, in the sensing operation, the number of low-noise amplifiers or integrators implemented in one source driver circuit (e.g., 1411) may be "a". In the case where the number of source driver circuits included in one display device 1000 is "n", the number of low-noise amplifiers or integrators implemented using source drivers in the sensing operation may be "a×n". Thus, in one sensing operation, the pixel information PI may be sensed from "a×n" pixels.

Figure 23:
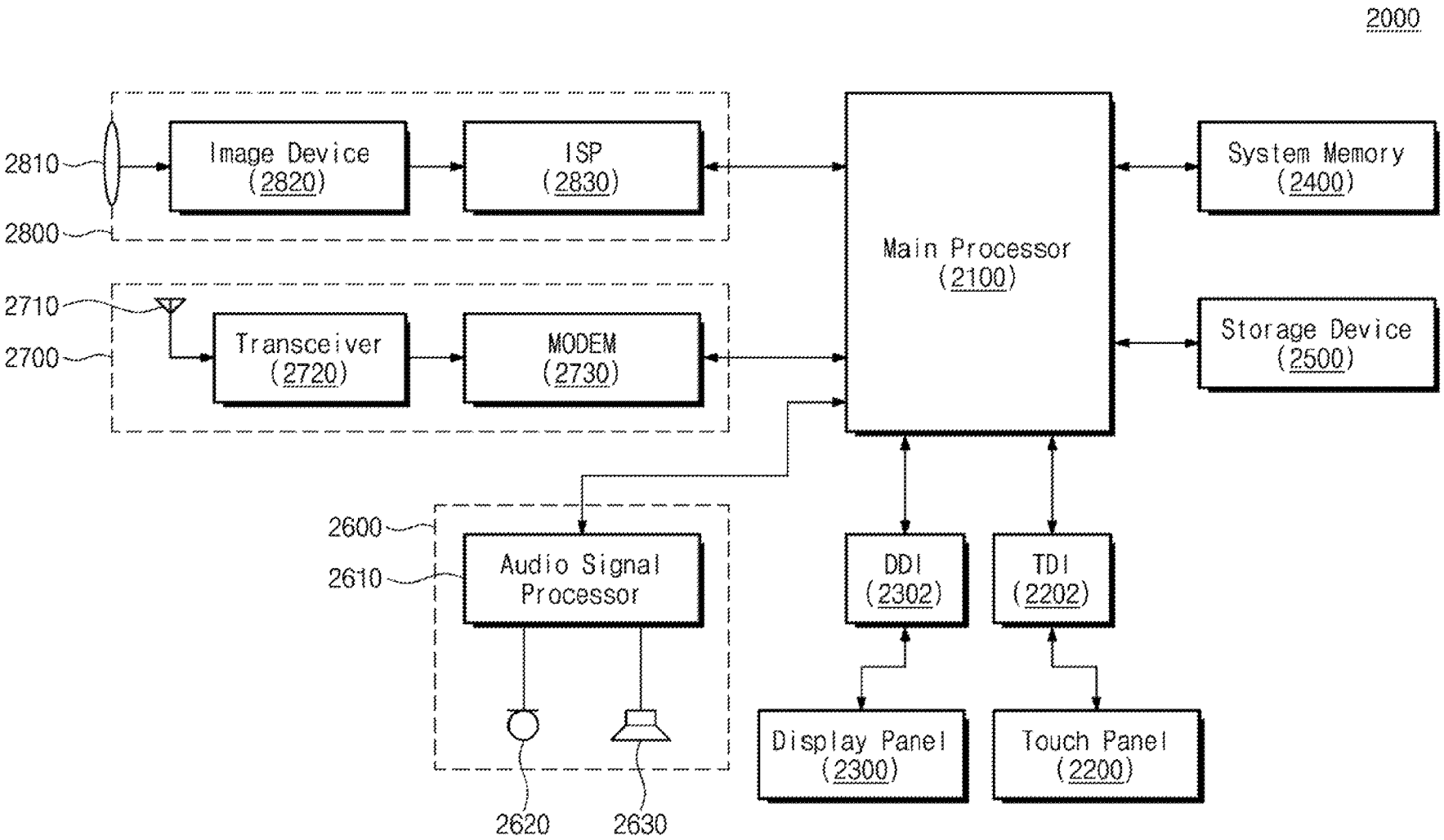
FIG. 23 is a block diagram illustrating an electronic device according to an example embodiment.

FIG. 23 is a block diagram illustrating an electronic device according to an example embodiment. Referring to FIG. 23, an electronic device 2000 may include a main processor 2100, a touch panel 2200, a touch driving integrated circuit 2202, a display panel 2300, a display driving integrated circuit 2302, a system memory 2400, a storage device 2500, an audio processor 2600, a communication block 2700, and an image processor 2800. In an example embodiment, the electronic device 2000 may be one of various electronic devices such as a portable communication terminal, a personal digital assistant (PDA), a portable media player (PMP), a digital camera, a smartphone, a tablet computer, a laptop computer, and a wearable device.

The main processor 2100 may control overall operations of the electronic device 2000. The main processor 2100 may control/manage operations of the components of the electronic device 2000. The main processor 2100 may process various operations for the purpose of operating the electronic device 2000.

The touch panel 2200 may be configured to sense a touch input from a user under control of the touch driving integrated circuit 2202. The display panel 2300 may be configured to display image information under control of the display driving integrated circuit 2302. In an example embodiment, the display driving integrated circuit 2302 may be the display driving integrated circuit DDI described with reference to FIGS. 1 to 22 or may operate based on the method of operating described with reference to FIGS. 1 to 22.

The system memory 2400 may store data that are used for an operation of the electronic device 2000. For example, the system memory 2400 may include a volatile memory such as a static random access memory (SRAM), a dynamic RAM (DRAM), or a synchronous DRAM (SDRAM), and/or a nonvolatile memory such as a phase-change RAM (PRAM), a magneto-resistive RAM (MRAM), a resistive RAM (ReRAM), or a ferroelectric RAM (FRAM).

The storage device 2500 may store data regardless of whether a power is supplied. For example, the storage device 2500 may include at least one of various nonvolatile memories such as a flash memory, a PRAM, an MRAM, a ReRAM, and a FRAM. For example, the storage device 2500 may include an embedded memory and/or a removable memory of the electronic device 2000.

The audio processor 2600 may process an audio signal using an audio signal processor 2610. The audio processor 2600 may receive an audio input through a microphone 2620 or may provide an audio output through a speaker 2630.

A communication block 2700 may exchange signals with an external device/system through an antenna 2710. A transceiver 2720 and a modulator/demodulator (MODEM) of the communication block 2700 may process signals exchanged with the external device/system, based on at least one of various wireless communication protocols: long term evolution (LTE), worldwide interoperability for microwave access (WiMax), global system for mobile communication (GSM), code division multiple access (CDMA), Bluetooth, near field communication (NFC), wireless fidelity (Wi-Fi), and radio frequency identification (RFID).

The image processor 2800 may receive a light through a lens 2810. An image device 2820 and an image signal processor 2830 included in the image processor 2800 may generate image information about an external object, based on a received light.

By way of summation and review, a transistor and an organic light-emitting diode of a pixel may degrade over time. When the transistor and the organic light-emitting diode degrade, the amount of current flowing through the organic light-emitting diode may change, and thus, the brightness of the pixel may become different from target brightness. Accordingly, the display device may implement a sensing operation of measuring the degree of degradation of the pixel and a compensation operation of compensating for the degradation of the pixel of a sensing result of the sensing operation.

As described, embodiments may provide a display device sensing pixel information for external compensation of the display device using a source driver, without a separate low-noise amplifier.

According to example embodiments, a display driving integrated circuit may drive a plurality of pixels using a plurality of source drivers in a display operation of a pixel and may sense pixel information from the plurality of pixels using the plurality of source drivers in a sensing operation of a pixel. Accordingly, because a separate low-noise amplifier or integrator for receiving pixel information used in external compensation of a display device may be omitted, the size and cost of the display driving integrated circuit may be reduced.

Components described in the specification using terms "part", "unit", "module", "block", etc. and function blocks illustrated in drawings may be implemented with software, hardware, or a combination thereof. For example, the software may be a machine code, firmware, an embedded code, and application software. For example, the hardware may include an electrical circuit, an electronic circuit, a processor, a computer, an integrated circuit, integrated circuit cores, a pressure sensor, an inertial sensor, a microelectromechanical system (MEMS), a passive element, or a combination thereof.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display driving integrated circuit for a display panel, the display driving integrated circuit comprising:

a timing controller;

a first source driver including a first inverting input terminal, a first non-inverting input terminal, and a first output terminal;

a second source driver including a second inverting input terminal, a second non-inverting input terminal, and a second output terminal; and a switching circuit that connects with the display panel through a first pad and a second pad, the switching circuit including a plurality of switches connected between the first and second pads and the first and second source drivers, wherein, under control of the timing controller, the switching circuit is configured to perform one of:

a first switching operation of controlling the plurality of switches such that the first inverting input terminal and the first output terminal are connected with the first pad, a first decoding voltage is applied to the first non-inverting input terminal, the second inverting input terminal and the second output terminal are connected with the second pad, and a second decoding voltage is applied to the second non-inverting input terminal; and a second switching operation of controlling the plurality of switches such that a sensing reference voltage is applied to the first non-inverting input terminal and the second non-inverting input terminal, the first output terminal and the second output terminal are connected with an output node, and the first inverting input terminal and the second inverting input terminal are connected with one pad of the first and second pads.

2. The display driving integrated circuit as claimed in claim 1, wherein the switching circuit is configured to perform the first switching operation, and when the switching circuit performs the first switching operation, the first source driver outputs the first decoding voltage to the display panel through the first pad, and the second source driver outputs the second decoding voltage to the display panel through the second pad.

3. The display driving integrated circuit as claimed in claim 1, wherein the timing controller controls the switching circuit such that the second switching operation is performed at least once, in one period of a vertical synchronization signal (VSYNC) received from an external device.

4. The display driving integrated circuit as claimed in claim 1, wherein the switching circuit is configured to perform the second switching operation, and when the switching circuit performs the second switching operation, the first source driver and the second source driver receive pixel information, which is provided through the one pad of the first pad and the second pad, through the first inverting input terminal and the second inverting input terminal, and output the received pixel information through the first output terminal and the second output terminal.

5. The display driving integrated circuit as claimed in claim 4, wherein the pixel information indicates a degree of degradation of a pixel, from among a plurality of pixels included in the display panel, that is connected with the one of the first pad and the second pad.

6. The display driving integrated circuit as claimed in claim 4, further comprising:

an analog-to-digital converter configured to convert the pixel information output through the first output terminal and the second output terminal into sensing data; and a memory configured to store the sensing data.

7. The display driving integrated circuit as claimed in claim 1, wherein the plurality of switches include:

a first display output switch connected between the first output terminal and the first pad;

a first display feedback switch connected between the first output terminal and the first inverting input terminal;

a first sensing feedback switch connected between the first inverting input terminal and an input node;

a first sensing output switch connected between the first output terminal and the output node;

a first sensing input switch connected between the input node and the first pad;

a first sensing reset switch connected between the first pad and a first reset data node;

a first selection switch configured to select one of the first decoding voltage and the sensing reference voltage so as to be provided to the first non-inverting input terminal;

a second display output switch connected between the second output terminal and the second pad;

a second display feedback switch connected between the second output terminal and the second inverting input terminal;

a second sensing feedback switch connected between the second inverting input terminal and the input node;

a second sensing output switch connected between the second output terminal and the output node;

a second sensing input switch connected between the input node and the second pad;

a second sensing reset switch connected between the second pad and a second reset data node;

a second selection switch configured to select one of the second decoding voltage and the sensing reference voltage so as to be provided to the second non-inverting input terminal;

a reset switch connected between the input node and the output node; and a capacitor connected between the input node and the output node.

8. The display driving integrated circuit as claimed in claim 7, wherein the switching circuit is configured to perform the first switching operation, and when the switching circuit performs the first switching operation, the first and second display output switches and the first and second display feedback switches are turned on, the first selection switch selects the first decoding voltage so as to be provided to the first non-inverting input terminal, the second selection switch selects the second decoding voltage so as to be provided to the second non-inverting input terminal, and the first and second sensing feedback switches, the first and second sensing output switches, the first and second sensing input switches, the first and second sensing reset switches, and the reset switch are turned off.

9. The display driving integrated circuit as claimed in claim 7, wherein:

the switching circuit is configured to perform the second switching operation, the second switching operation includes a reset period and a sensing period, and in the reset period, one of the first and second sensing reset switches is turned on, one of the first and second sensing input switches is turned on, the first and second sensing feedback switches, the first and second sensing output switches, and the reset switch are turned on, and the first and second display output switches and the first and second display feedback switches are turned off.

10. The display driving integrated circuit as claimed in claim 9, wherein, in the reset period, the first sensing input switch of the first and second sensing input switches is turned on when the first sensing reset switch of the first and second sensing reset switches is turned on, and the second sensing input switch of the first and second sensing input switches is turned on when the second sensing reset switch of the first and second sensing reset switches is turned on.

11. The display driving integrated circuit as claimed in claim 9, wherein, in the sensing period after the reset period, the first and second sensing reset switches and the reset switch are turned off.

12. A display driving integrated circuit for a display panel, the display driving integrated circuit comprising:

a timing controller;

a column control block including a plurality of source drivers, and configured to, under control of the timing controller, control voltages of a plurality of pixel lines, which connect to the display panel, by connecting the plurality of source drivers in a first configuration in which respective source drivers are connected one-by-one to respective pixel lines, and to receive pixel information through the plurality of pixel lines using the plurality of source drivers by connecting the plurality of source drivers in a second configuration in which at least two source drivers are commonly connected to a single pixel line;

an analog-to-digital converter configured to convert the pixel information received by the column control block into sensing data; and a memory configured to store the sensing data.

13. The display driving integrated circuit as claimed in claim 12, wherein the column control block further includes a switching circuit configured to connect between the plurality of source drivers and the plurality of pixel lines in the first configuration or the second configuration under control of the timing controller.

14. The display driving integrated circuit as claimed in claim 13, wherein the switching circuit includes:

a plurality of display output switches connected between the plurality of pixel lines and the plurality of source drivers;

a plurality of display feedback switches connected between output terminals and inverting input terminals of the plurality of source drivers;

a plurality of sensing feedback switches connected between the inverting input terminals of the plurality of source drivers and an input node;

a plurality of sensing output switches connected between the output terminals of the plurality of source drivers and an output node;

a plurality of sensing input switches connected between the input node and the plurality of pixel lines;

a plurality of selection switches configured to select either a plurality of decoding voltages or a sensing reference voltage so as to be provided to non-inverting input terminals of the plurality of source drivers;

a plurality of sensing reset switches configured to selectively provide a plurality of sensing reset data to the plurality of pixel lines, respectively;

a reset switch connected between the input node and the output node; and a capacitor connected between the input node and the output node.

15. The display driving integrated circuit as claimed in claim 14, wherein, when the plurality of display output switches and the plurality of display feedback switches are turned on, the plurality of selection switches select the plurality of decoding voltages, respectively, and the plurality of sensing feedback switches, the plurality of sensing output switches, the plurality of sensing input switches, the plurality of sensing reset switches, and the reset switch are turned off, the plurality of source drivers control voltages of the plurality of pixel lines.

16. The display driving integrated circuit as claimed in claim 14, wherein, when the plurality of display output switches and the plurality of display feedback switches are turned off, the plurality of selection switches select the sensing reference voltage, and a corresponding one of the plurality of sensing input switches, a corresponding one of the plurality of sensing reset switches, the plurality of sensing feedback switches, the plurality of sensing output switches, and the reset switch are turned on, the plurality of source drivers output a reset voltage, and wherein, after the reset voltage is output from the plurality of source drivers, when the reset switch and the corresponding one of the plurality of sensing reset switches are turned off, the plurality of source drivers receive the pixel information from a pixel line connected with a corresponding one of the plurality of sensing input switches and output the received pixel information.

17. A display device, comprising:

a display panel including a plurality of pixels; and a display driving integrated circuit configured to control the plurality of pixels, the display driving integrated circuit including a plurality of source drivers connected with the plurality of pixels through a plurality of pixel lines, wherein, in a display operation of the plurality of pixels, respective ones of the plurality of source drivers are connected one-by-one to respective ones of the plurality of pixel lines, to output a plurality of decoding voltages to the plurality of pixel lines, respectively, and wherein, in a sensing operation of a pixel of the plurality of pixels, at least two source drivers of the plurality of source drivers are commonly connected to a single pixel line, of the plurality of pixel lines, to be connected to the pixel and receive pixel information from the pixel.

18. The display device as claimed in claim 17, wherein the plurality of pixels are arranged in the display panel in a plurality of rows and a plurality of columns, wherein the display operation indicates an operation of controlling brightness of pixels at one row of the plurality of rows, and wherein the sensing operation indicates an operation of receiving the pixel information from at least one pixel of the pixels at the one row of the plurality of rows.

19. The display device as claimed in claim 18, wherein the display operation is performed once every period of a horizontal synchronization signal, and wherein the sensing operation is performed "m" times in "n" periods of the horizontal synchronization signal (m and n being a natural number).

20. The display device as claimed in claim 18, wherein the display operation is performed once every period of a horizontal synchronization signal, and wherein the sensing operation is performed "m" times in a vertical blank period, m being a natural number.

* * * * *